US006609336B2

(12) United States Patent
Matsubara

(10) Patent No.: US 6,609,336 B2
(45) Date of Patent: Aug. 26, 2003

(54) MODULAR UNITS, MODULAR STRUCTURES HAVING MODULAR UNITS, AND METHOD FOR CONSTRUCTING MODULAR STRUCTURES

(76) Inventor: Hideo Matsubara, 1-1-1001, Kita 5-jo Nishi 29-chome, Chuo ku, Sapporo-shi Hokkaido (JP)

( * ) Notice: Subject to any disclaimer, the term of this patent is extended or adjusted under 35 U.S.C. 154(b) by 23 days.

(21) Appl. No.: 09/765,551

(22) Filed: Jan. 19, 2001

(65) Prior Publication Data

US 2002/0059756 A1 May 23, 2002

(30) Foreign Application Priority Data

Jan. 20, 2000 (JP) ..... 2000-011859

(51) Int. Cl.[7] ..... A63H 33/12; E04B 1/10

(52) U.S. Cl. ..... 52/79.12; 52/234; 52/270; 52/284; 52/285.2; 52/585.1; 446/123; 446/115

(58) Field of Search ..... 52/79.1, 79.12, 52/234, 270, 284, 285.1, 271, 285.4, 584.1, 584.2, 585.1, 745.13; 446/123, 108, 112–115, 122

(56) References Cited

U.S. PATENT DOCUMENTS

| | | | | |
|---|---|---|---|---|
| 1,308,254 A | | 7/1919 | Otto | |
| 1,671,505 A | | 5/1928 | Bemis | |
| 2,258,156 A | | 10/1941 | Cavalieri | |
| 2,493,435 A | | 1/1950 | Archambault | |
| 3,004,364 A | | 10/1961 | Benkelman | |
| 3,080,674 A | | 3/1963 | Amici | 52/286 X |
| 3,236,014 A | | 2/1966 | Edgar | 52/286 X |
| 3,305,982 A | | 2/1967 | Steele | 52/286 X |
| 3,362,739 A | | 1/1968 | Staeger et al. | 52/285.1 |
| 3,604,146 A | | 9/1971 | Winer | |
| 3,820,294 A | * | 6/1974 | Parker | 52/262 |
| 4,270,303 A | | 6/1981 | Xanthopoulos et al. | |
| 5,802,780 A | | 9/1998 | Hammerschlag | |
| 6,014,842 A | * | 1/2000 | Matsubara | 52/79.12 |

FOREIGN PATENT DOCUMENTS

| | | |
|---|---|---|
| JP | 10169078 | 6/1998 |

* cited by examiner

*Primary Examiner*—Jeanette Chapman
(74) *Attorney, Agent, or Firm*—Adams & Wilks

(57) ABSTRACT

A modular unit system for constructing a modular structure comprises different modular unit sets each having identical modular units. The modular units of each modular unit set has connecting surfaces each for connection to a corresponding connecting surface of at least one other identical modular unit or to a corresponding connecting surface of one of the modular units of another of the modular unit sets to construct a modular structure, such as a building structure, having a predetermined configuration. All of the modular units of each of the modular unit sets have a ladder-like configuration having at least two generally parallel sidepieces connected by at least four crosspieces except for the modular units of one preselected modular unit set. Each modular unit of one of the modular unit sets having the ladder-like configuration has a support member disposed between the two generally parallel sidepieces in parallel relation thereto. The support member has at least one connecting surface for connection to a corresponding connecting surface of at least one other identical modular unit or to a corresponding connecting surface of one of the modular units of another of the modular unit sets.

34 Claims, 25 Drawing Sheets

MODULAR UNITS, MODULAR STRUCTURES HAVING MODULAR UNITS, AND METHOD FOR CONSTRUCTING MODULAR STRUCTURES

BACKGROUND OF THE INVENTION

1. Field of the Invention

The present invention relates generally to modular construction systems and, more particularly, to construction systems which employ a plurality of connectable modular units which can be assembled by amateur builders to construct modular structures having various structural configurations with improved wind load resistance. The present invention also relates to methods for constructing modular structures using the modular units.

2. Background Information

The construction of building structures has been primarily carried out by large professional construction companies and/or builders. Both skilled and unskilled labor has been required to employ the various conventional methods for construction of building structures, which increases the overall construction cost. Furthermore, due to the requirement for skilled labor, the construction of conventional building structures has not been able to be completely realized by amateur builders.

Moreover, the construction of conventional building structures often requires more than one worker for handling the various construction components due to their large size and weight. Additionally, the safety of construction workers is often compromised since most operations in conventional building construction methods must be carried out from the exterior of the building structures.

Many of the modern buildings are being constructed with modular units, which greatly facilitates the construction of the building by reducing costly amounts of skilled and unskilled labor as well as reducing the amount of construction time. However, these modular units are quite costly and not universally adaptable to a wide variety of applications.

Japanese Patent Application No. 8-340646, filed Dec. 4, 1996 by the present inventors (now JP-A-10-169078, dated Jun. 23, 1998) and corresponding to U.S. Pat. No. 6,014,842, discloses a method for constructing a building structure using wood blocks. However, such construction method suffers from the drawback that when the wood blocks are large in size (e.g., the height of the building structure above ground level is increased), the resistance of the building structure to pressures exerted by wind is decreased.

SUMMARY OF THE INVENTION

The present invention is directed to a set of modular units, modular structures constructed of the modular units, and a method for constructing the modular structures, which overcome the foregoing drawbacks of the conventional art.

It is an object of the present invention to provide a set of modular units which is not expensive to manufacture and which is adaptable to a wide variety of modular structures.

Another object of the present invention is to provide a set of modular units which can be readily assembled by amateur builders to construct modular structures in a relatively short period of time.

Another object of the present invention is to provide a set of modular units each of which is of a configuration, size and weight so as to enable a single amateur builder with minimum amounts of skill to transport and manipulate the same during construction of modular structures.

Another object of the present invention is to provide a set of modular units which can be readily assembled by amateur builders to construct modular structures using only a minimum z number of simple connection elements and which does not require special tools for the assembly.

Another object of the present invention is to provide a set of modular units which can be assembled to construct modular structures with improved wind load resistance.

Another object of the present invention is to provide a modular structure which utilizes modular units to provide a final framework capable of assuming nearly any shape or size.

Another object of the present invention is to provide a method of constructing a modular structure which reduces costly amounts of skilled and unskilled labor and which reduces the amount of construction time.

Another object of the present invention is to provide a modular building structure and a construction method therefor in which all of the assembly operations, except for the construction of a roof structure, can be performed from the interior of the building structure.

The foregoing and other objects of the present invention are carried out by a modular unit system comprising a plurality of generally different modular unit sets each having a plurality of identical modular units. The modular units of at least one of the modular unit sets have a ladder-like configuration. The modular units of each modular unit set have connecting surfaces each for connection to a corresponding connecting surface of at least one identical modular unit or to a corresponding connecting surface of at least one of the modular units of another of the modular unit sets to construct a modular structure having a predetermined configuration.

In another aspect, the present invention provides a modular structure construction comprising a plurality of generally different modular unit sets each having a plurality of identical modular units, the modular units of each modular unit set having connecting surfaces, and means interconnecting each connecting surface of each modular unit of each modular unit set to a corresponding connecting surface of at least one other identical modular unit or to a corresponding connecting surface of one of the modular units of another of the modular unit sets to define the modular structure. The modular units of at least one of the modular unit sets have a ladder-like configuration.

In another aspect, the present invention provides a building system comprising a building having a foundation, at least one wall structure, and at least one floor structure for supporting the wall structure on the foundation. The wall structure and the floor structure comprise a plurality of generally different modular unit sets each having a plurality of identical modular units. The modular units of at least one of the modular unit sets have a ladder-like configuration. The modular units of each modular unit set have connecting surfaces each for connection to a corresponding connecting surface of at least one other identical modular unit or to a corresponding connecting surface of one of the modular units of another of the modular unit sets to define the wall structure and the floor structure.

In one embodiment, the plurality of modular unit sets of each of the foregoing modular unit system, the modular structure construction and the building system comprise seven modular units sets. The modular units of six of the modular unit sets have a ladder-like configuration. The modular units of the seventh modular unit set have a generally L-shaped outline.

In another aspect, the present invention provides a modular structure construction comprising a plurality of first modular units each having a ladder-like configuration and a plurality of second modular units each having a generally L-shaped outline. Each of the first and second modular units has connecting surfaces for connection to a corresponding connecting surface of at least one other of the first and second modular units to define the modular structure construction.

In another aspect, the present invention provides a method for constructing modular structures using the modular units according to the present invention.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENTS

Figure 1:
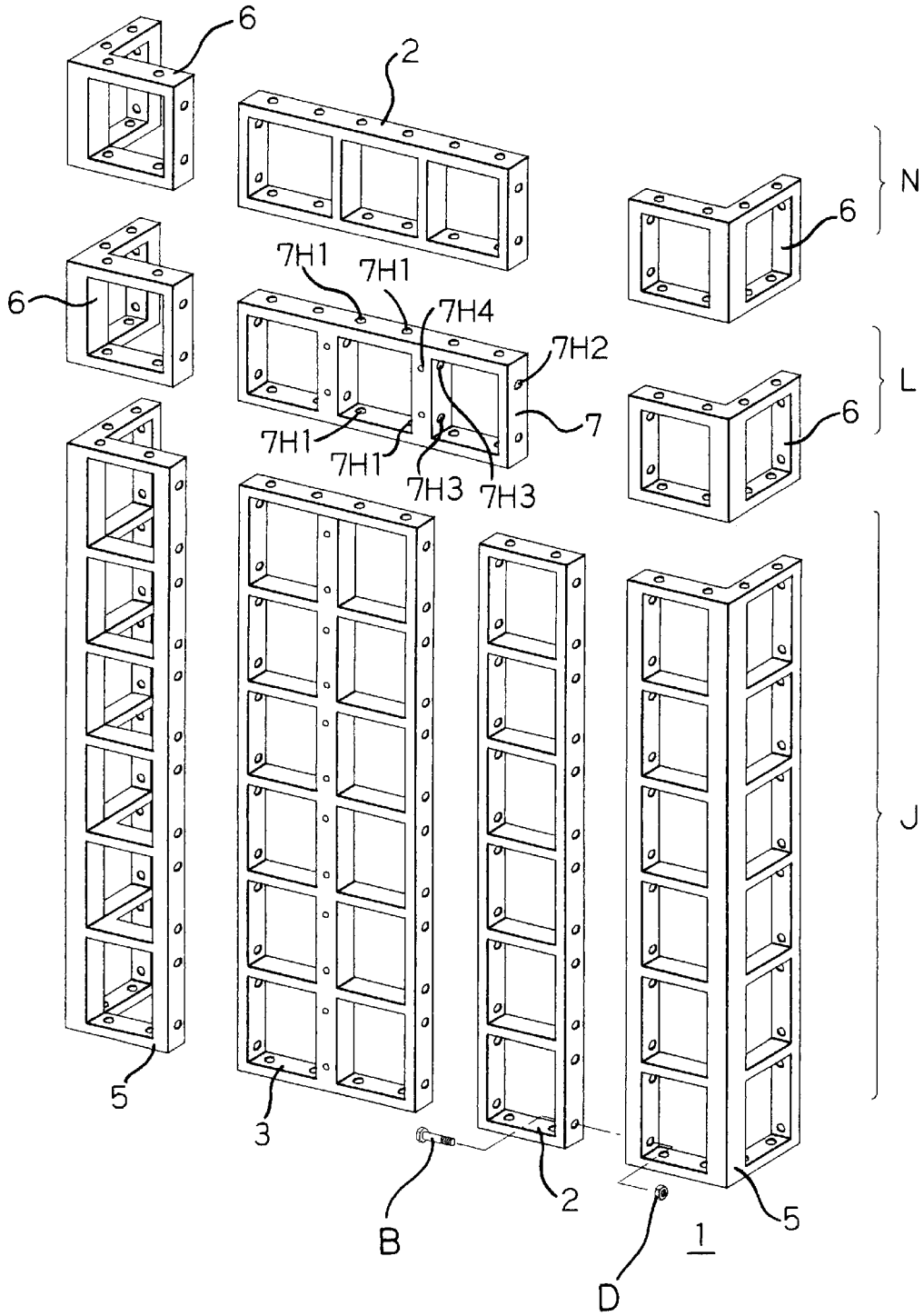
FIG. 1 is an exploded perspective view showing the relation between modular units utilized in a modular structure according to the present invention.

The present invention relates generally to modular units, modular structures constructed of the modular units, and methods for constructing the modular structures. For illustrative purposes only, the present invention will be described with reference to modular building structures, such as one-story and two-story houses, it being understood that the particular application to building structures and the configurations thereof shown are for illustrative purposes only and merely represent several of the multitude of different types of modular structures and configurations thereof that can be realized according to the present invention. Thus the present invention is in no way limited or restricted to the particular modular structures and configurations illustrated in the drawings.

As used throughout the specification and claims, the term "modular unit" refers to and means a single structural component which may be formed as a unitary structure from a single piece of material, or which may be formed of two or more pieces of material integrated together to form a single block unit. The term "block" refers to and means a structure or support having components which are formed, for example, of a solid or hollow material and which may be formed of a single piece of solid or hollow material or two or more pieces of solid or hollow materials integrated together. The term "modular structure" refers to and means a structure which is constructed from a plurality of modular units and which may be constructed in a wide variety of structural forms. For example, the modular units can be connected together in the form of a building structure, a transport system (e.g., container structure), or a bridge structure.

Moreover, certain terminology is used in the following description for convenience only and is not intended to be limiting. For purposes of this description, the terms "vertical" and "horizontal" are merely illustrative of relative space positions of the various components in the drawings. In actual practice, it is apparent that the components can be aligned in either orientation. Moreover, the terms "upper", "lower", "front", "rear", "left", "right", "inner" and "outer" designate directions in the drawing to which reference is made. Such terminology includes the terms above specifically mentioned and words of similar import.

FIGS. 16–30 show methods of constructing modular building structures according to the present invention. The modular building structures are constructed using a plurality of modular units according to the present invention which can be connected together by amateur builders having relatively low construction skills to construct the modular building structures.

Figure 4:
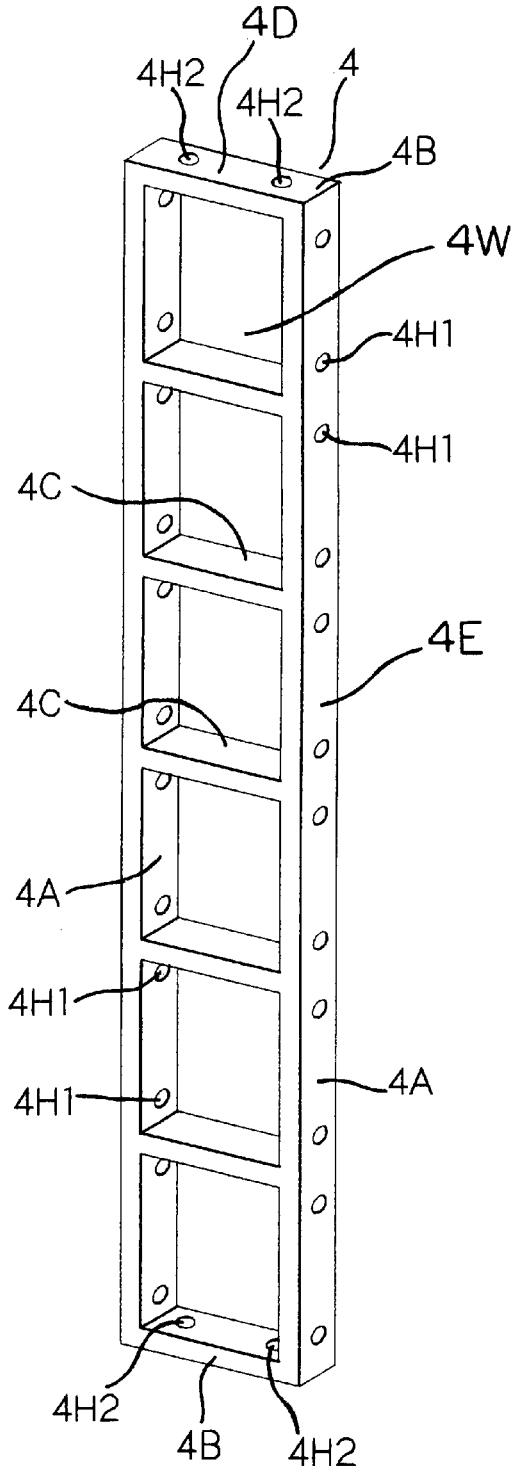
FIG. 4 is a perspective view of a modular unit in the form of a third ladder-like frame utilized in a modular structure according to the present invention.
Figure 8:
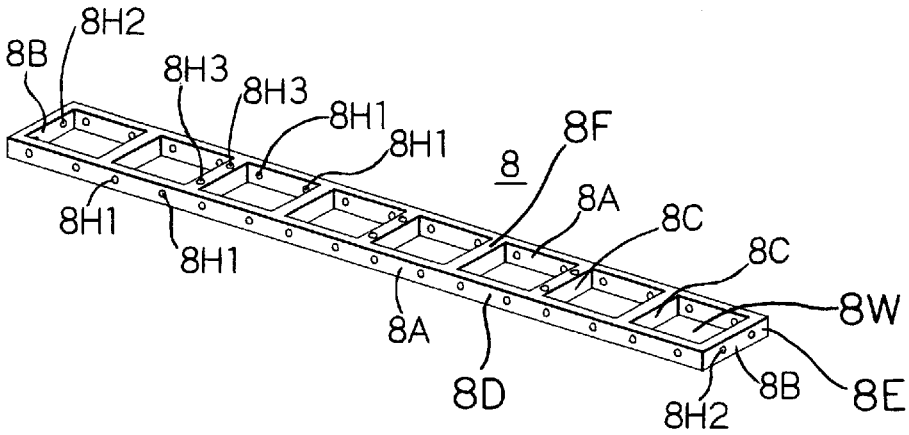
FIG. 8 is a perspective view of a modular unit in the form of a sixth ladder-like frame utilized in a modular structure according to the present invention.

FIG. 1 is an exploded perspective view of a structural portion 1 of a modular building structure showing the relation between modular units 2–3 and 5–7 according to the present invention. Two other modular units 4 and 8 according to the present invention which are not shown in FIG. 1 are shown in FIGS. 4 and 8, respectively. In FIG. 1, N, L and J denote a parapet, a crossbeam of a floor structure and a wall face of a floor structure, respectively, for a modular building structure according to the present invention.

Figure 2:
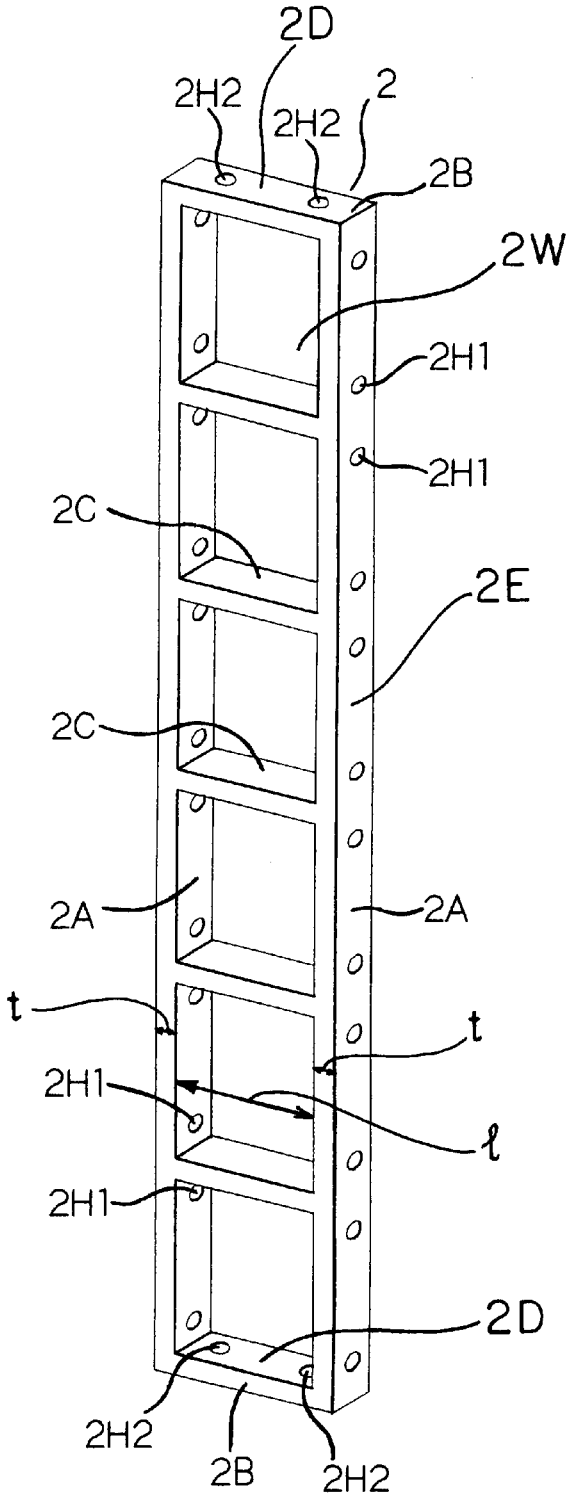
FIG. 2 is a perspective view of a modular unit in the form of a first ladder-like frame utilized in a modular structure according to the present invention.

As shown in FIG. 2, the modular unit 2 comprises a block having a ladder-like configuration (hereinafter referred to as "the first ladder-like frame"). The first ladder-like frame 2 is a generally rectangular-shaped open block structure which, as further described below, is utilized, for example, as a beam or a crossbeam for the construction of a modular building structure according to the present invention. The first ladder-like frame 2 comprises a pair of parallel, spaced-apart left and right members 2A and a pair of parallel, spaced-apart transverse members 2B connecting the left and right members in spaced-apart relation. The transverse members 2B are each connected to respective ends of the left and right members 2A in perpendicular relation thereto. A plurality of reinforcing members 2C are disposed between the left and right members 2A in parallel relation to the transverse members 2B and at equally spaced intervals to define openings 2W. The reinforcing members 2C are connected to inner surfaces of the left and right members 2A. The left, right, transverse and reinforcing members are preferably generally plate-shaped and are connected as described above to form the first ladder-like frame 2.

A plurality of vertical connecting through-holes 2H2 are formed in horizontal connecting surfaces 2D of the transverse members 2B. A plurality of horizontal connecting through-holes 2H1 are formed in vertical connecting surfaces 2E of the left and right members 2A at predetermined intervals. The through-holes 2H1, 2H2 permit the first ladder-like frame 2 to be connected to other modular units and/or other structural components of the modular structure.

Figure 3:
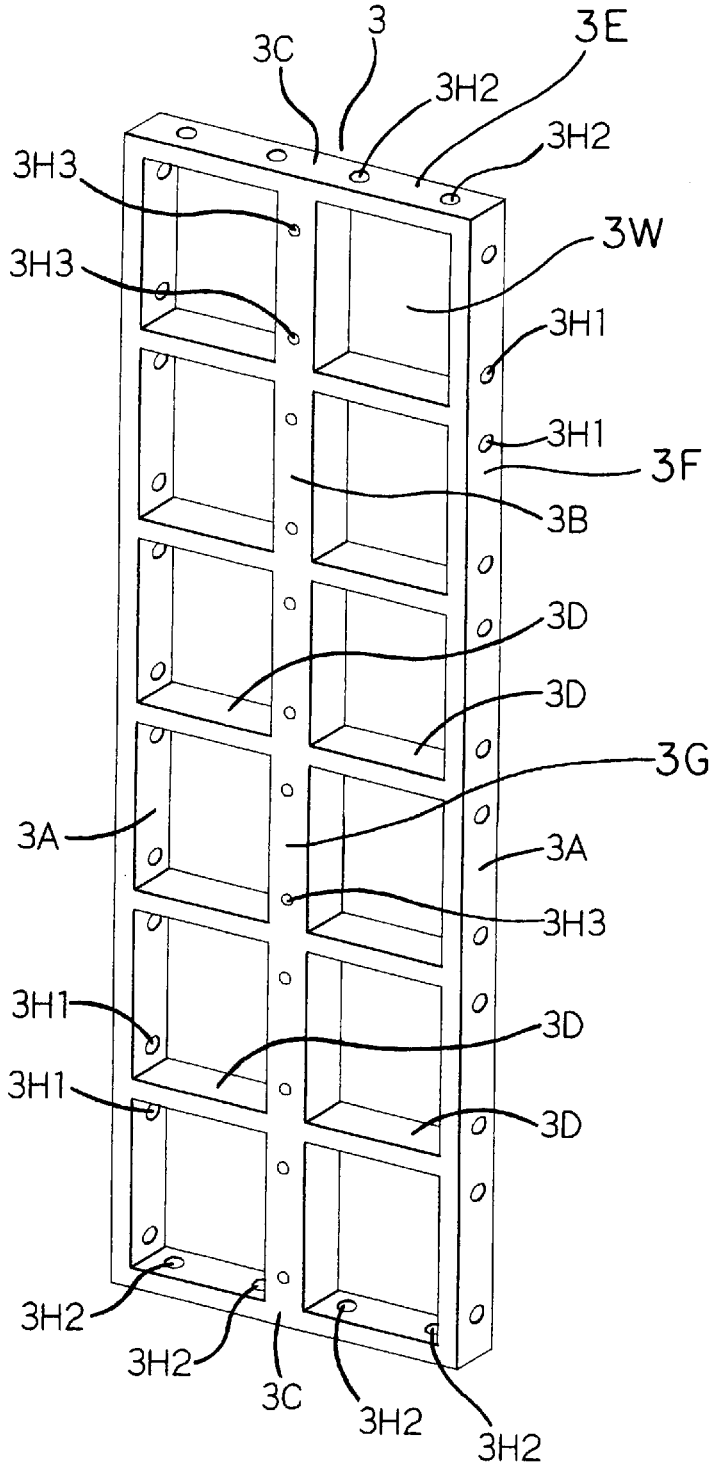
FIG. 3 is a perspective view of a modular unit in the form of a second ladder-like frame utilized in a modular structure according to the present invention.

Referring to FIG. 3, the modular unit 3 comprises a block having a ladder-like configuration (hereinafter referred to as "the second ladder-like frame"). The second ladder-like frame 3 comprises a generally rectangular-shaped open block structure having a pair of parallel, spaced-apart left and right members 3A and a pair of parallel, spaced-apart transverse members 3C connecting the left and right members in spaced-apart relation. The transverse members 3C are each connected to respective ends of the left and right members 3A in perpendicular relation thereto A pillar-like member 3B is disposed centrally between the left and right members 3A in parallel relation thereto and has opposite ends connected to respective central portions of the transverse members 3C. A plurality of reinforcing members 3D are disposed between the left member 3A and the pillar-like member 3B and between the right member 3A and the pillar-like member 3B in parallel relation to the transverse members 3C and at equally spaced intervals along the left and right members 3A to define openings 3W. The left, right, transverse and reinforcing members are preferably generally plate-shaped and are connected as described above, together with the pillar-like member 3B, to form the second ladder-like frame 3.

A plurality of vertical connecting through-holes 3H2 are formed in horizontal connecting surfaces 3E of the transverse members 3C. A plurality of horizontal connecting through-holes 3H1 are formed in vertical connecting surfaces 3F of the left and right members 3A at predetermined intervals. A plurality of horizontal connecting through-holes 3H3 are formed along connecting surfaces 3G of the pillar-like member 3B at predetermined intervals and extend in a direction generally perpendicular to the connecting through-holes 3H1 and 3H2. The connecting through-holes 3H1, 3H2, 3H3 permit the second ladder-like frame 3 to be connected to other modular units and/or other structural components of the modular structure.

Referring to FIG. 4, the modular unit 4 comprises a block having a ladder-like configuration (hereinafter referred to as "the third ladder-like frame"). The third ladder-like frame 4 is a generally rectangular-shaped open block structure having substantially the same structure as the first ladder-like structure 2. In this regard, the third ladder-like frame 4 has left and right members 4A, transverse members 4B, reinforcing members 4C, connecting surfaces 4D, 4E, openings 3W and horizontal connecting through-holes 4H1 and vertical connecting through-holes 4H2. As further described below with reference to FIG. 14, the only difference between the first and third ladder-like frames 2, 4 is that a width a corresponding to the distance between connecting surfaces 2E of the left and right members 2A of the first ladder-like frame 2 is greater than a width b corresponding to the distance between connecting surfaces 4E of the left and right members 4A of the third ladder-like frame 4.

Figure 5:
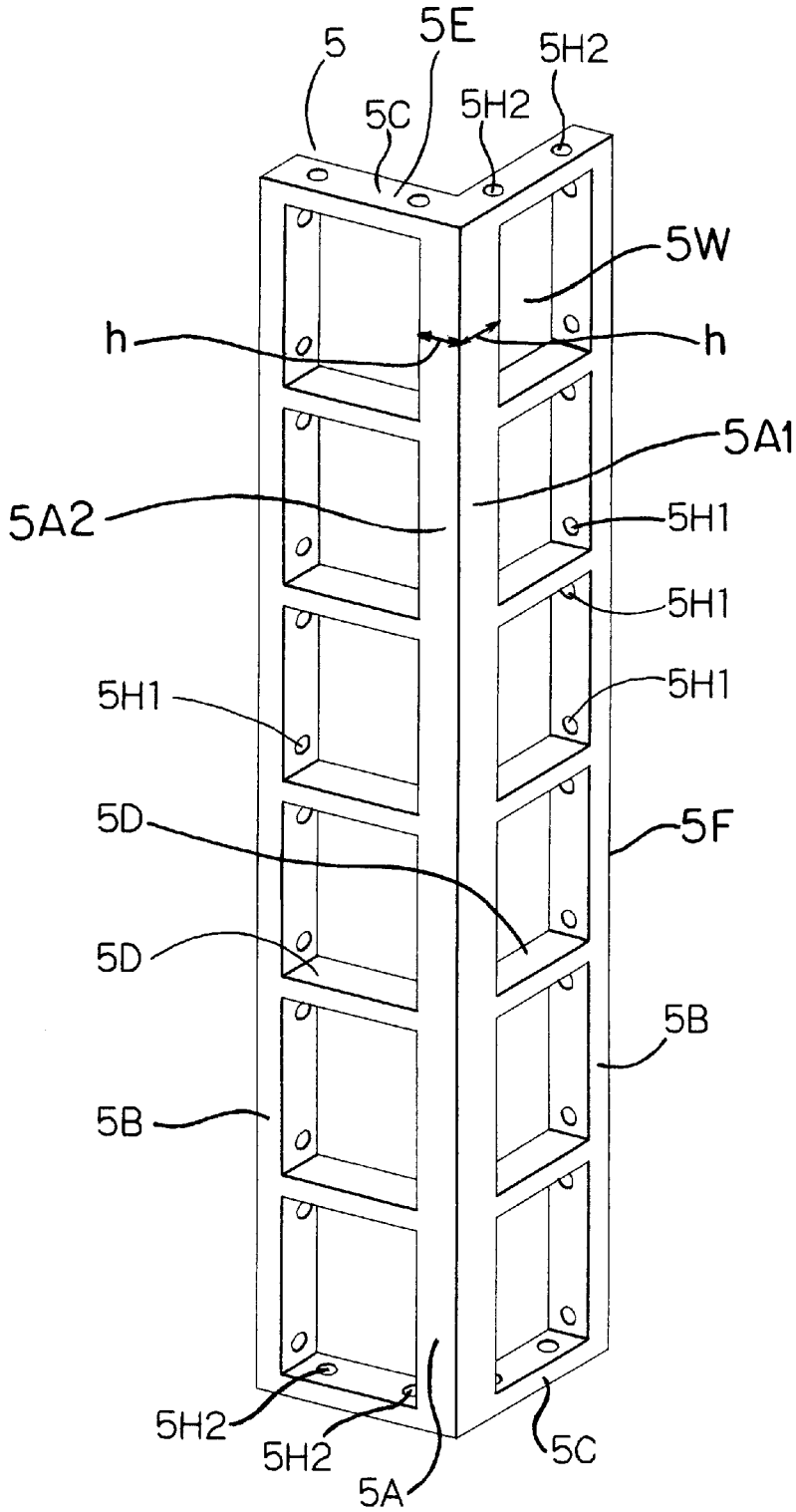
FIG. 5 is a perspective view of a modular unit in the form of a fourth ladder-like frame utilized in a modular structure according to the present invention.

Referring now to FIG. 5, the modular unit S according to the present invention comprises an open block structure having a ladder-like configuration (hereinafter referred to as "the fourth ladder-like frame"). The fourth ladder-like frame 5 has a pair of parallel, spaced-apart upper and lower members 5C and a plurality of spaced-apart transverse or vertical members 5B connecting the upper and lower members in spaced-apart relation. In this embodiment, two of the vertical members SB are each connected to respective ends of the upper and lower members 5C in perpendicular relation thereto. A pillar-like member 5A is disposed centrally between the vertical members 5B in parallel relation thereto and has opposite ends connected to respective central portions of the upper and lower members 5C. A plurality of reinforcing members 5D are disposed between the left vertical member 5B and the pillar-like member SA and between the right vertical member 5B and the pillar-like member 5A in parallel relation to the upper and lower members 5C and at equally spaced intervals along the vertical members SB to define openings 5W. Each of the upper and lower members 5C comprises a pair of leg portions which are preferably perpendicular with respect to each other. When viewed from above in FIG. 5, the fourth ladder-like frame 5 has a generally L-shaped outline and, as further described below, is utilized, for example, as a corner structural component of a modular building structure according to the present invention. The upper, lower, vertical and reinforcing members are preferably generally plate-shaped and are connected as described above, together with the pillar-like member 5A, to form the fourth ladder-like frame 5.

A plurality of vertical connecting through-holes 5H2 are formed in connecting surfaces 5E of the upper and lower members 5C. A plurality of horizontal connecting through-holes 5H1 are formed in connecting surfaces SF of the vertical members 5B at predetermined intervals. The through-holes SHI, 5H2 permit the fourth ladder-like frame 5 to be connected to other modular units and/or other structural components of the modular structure.

Figure 6:
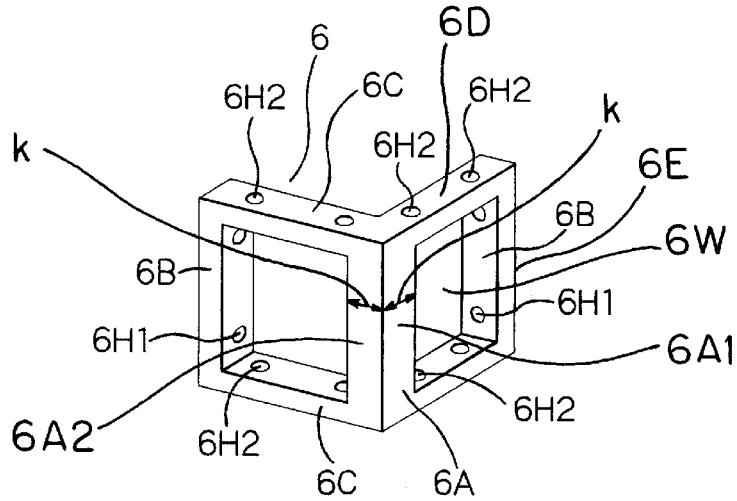
FIG. 6 is a perspective view of an L-shaped modular unit utilized in a modular structure according to the present invention.

Referring now to FIG. 6, the modular unit 6 according to the present invention comprises a corner block (hereinafter referred to as "corner modular unit") having an open structure and a generally L-shaped outline when viewed from above in FIG. 6. The corner modular unit 6 has a pair of parallel, spaced-apart upper and lower members 6C and a plurality of spaced-apart transverse or vertical members 6B connecting the upper and lower members in spaced-apart relation. In this embodiment, two of the vertical members 6B are each connected to respective ends of the upper and lower members 6C in perpendicular relation thereto. A pillar-like member 6A is disposed centrally between the vertical members 6B in parallel relation thereto and has opposite ends connected to respective central portions of the upper and lower members 6C, thereby defining a block having an open structure having openings 6W. Each of the upper and lower members 6C comprises a pair of leg portions which are preferably perpendicular with respect to each other. As further described below, the corner modular unit 6 is utilized, for example, as a corner structural component of a modular building structure according to the present invention.

A plurality of connecting vertical through-holes 6H2 are formed in upper and lower connecting surfaces 6D of the upper and lower members 6C near the ends thereof, and a plurality of horizontal connecting through-holes 6H1 are formed in connecting surfaces 6E of the vertical members 6B near the ends thereof for connecting the corner modular unit 6 to other modular units and/or other structural components of the modular structure.

Figure 7:
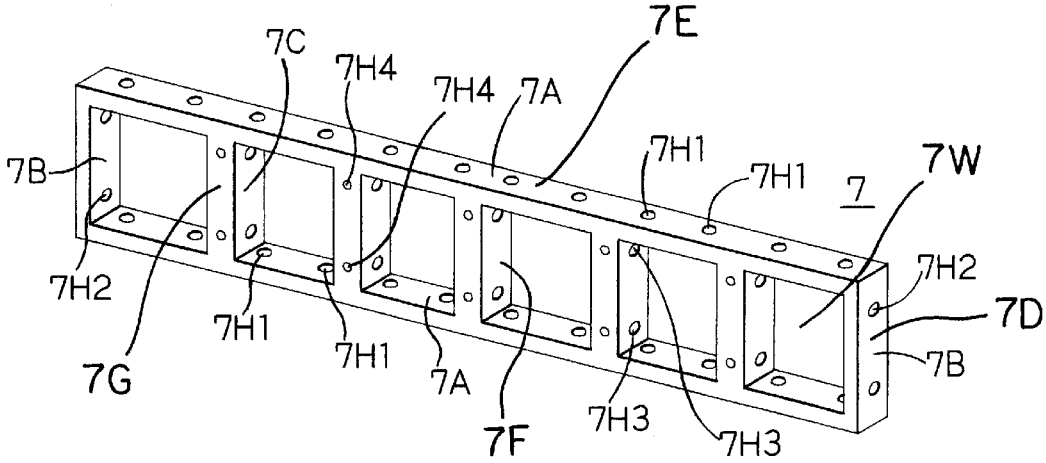
FIG. 7 is a perspective view of a modular unit in the form of a fifth ladder-like frame utilized in a modular structure according to the present invention.

As shown in FIG. 7, the modular unit 7 comprises a block having a ladder-like configuration (hereinafter referred to as "the fifth ladder-like frame"). The fifth ladder-like frame 7 is a generally rectangular-shaped open block structure which, as further described below, is utilized, for example, as a beam or a crossbeam for the construction of a modular building structure according to the present invention. The fifth ladder-like frame 7 comprises a pair of parallel, spaced-apart upper and lower members 7A and a pair of parallel, spaced-apart transverse members 7B connecting the upper and lower members in spaced-apart relation. The transverse members 7B are each connected to respective ends of the upper and lower members 7A in perpendicular relation thereto. A plurality of reinforcing members 7C are disposed between the upper and lower members 7A in parallel relation to the transverse members 7B and at equally spaced intervals to define openings 7W. The reinforcing members 7C are connected to inner surfaces of the upper and lower members 7A. The upper, lower, transverse and reinforcing members are preferably generally plate-shaped and are connected as described above to form the fifth ladder-like frame 7.

A plurality of horizontal connecting through-holes 7H2 are formed in connecting surfaces 7D of the transverse members 7B. A plurality of vertical connecting through-holes 7H1 are formed in connecting surfaces 7E of the upper and lower members 7A at predetermined intervals. Horizontal connecting through-holes 7H3 are formed in connecting surfaces 7F of the reinforcing members 7C. Vertical connecting through-holes 7H4 are formed in connecting surfaces 7G of the reinforcing members 7C. The through-holes 7H1, 7H2, 7H3 and 7H4 permit the fifth ladder-like frame 7 to be connected to other modular units and/or other structural components of the modular structure.

As shown in FIG. 8, the modular unit 8 comprises a block having a ladder-like configuration (hereinafter referred to as "the sixth ladder-like frame"). The sixth ladder-like frame 8 is a generally rectangular-shaped open block structure which, as further described below, is utilized, for example, as a beam or a crossbeam for a floor portion of a modular building structure according to the present invention. The sixth ladder-like frame 8 comprises a pair of parallel, spaced-apart front and rear members 8A and a pair of parallel, spaced-apart transverse members 8B connecting the front and rear members in spaced-apart relation. The transverse members 8B are each connected to respective ends of the front and rear members 8A in perpendicular relation thereto. A plurality of reinforcing members 8C are disposed between the front and rear members 8A in parallel relation to the transverse members 8B and at equally spaced intervals to define openings 8W. The reinforcing members 8C are connected to inner surfaces of the front and rear members 8A. The front, rear, transverse and reinforcing members are preferably generally plate-shaped and are connected as described above to form the sixth ladder-like frame 8.

A plurality of horizontal connecting through-holes 8H1 are formed in connecting surfaces 8D of the front and rear members 8B at predetermined intervals. A plurality of horizontal connecting through-holes 8H2 are formed in connecting surfaces 8E of the transverse members 8B. Vertical connecting through-holes 8H3 are formed in connecting surfaces 8F of several of the reinforcing members 8C. In the embodiment shown in FIG. 8, the connecting through-holes 8H3 are formed in connecting surfaces 8F of alternating reinforcing members 8C (i.e., in only three of the seven reinforcing members 8C). The through-holes 8H1, 8H2 and 8H3 permit the sixth ladder-like frame 8 to be connected to other modular units and/or other structural components of the modular structure.

Preferably, each of the first through sixth ladder-like frames 2–5 and 7–8 and the corner modular unit 6 is formed as an integral unit from a single piece of material, such as wood. However, it is understood by those skilled in the art that the ladder-like frames 2–5, 7–8 and the corner modular unit 6 may be formed of structural materials other than wood. For example, structural materials including hardened wood chips, metals such as iron, steel, aluminum or the like, or any of a number of known plastic materials such as polystyrene, several of the vinyl chlorides, several of the polyacrylates and polymethacylates, and the like are suitable for the ladder-like frames 2–5, 7–8 and the corner modular unit 6. Furthermore, it is understood by those skilled in the art that for each of the ladder-like frames 2–5, 7–8 and the corner modular unit 6, the upper and lower members, the left and right members, and the front and rear members may be formed from a single piece of material and that the reinforcing members and/or pillar-like members may be connected between respective ones of the upper and lower members, the left and right members, and the front and rear members using suitable connectors. Alternatively, all of the structural members of each of the ladder-like frames 2–5, 7–8 and the corner modular unit 6 may be formed from separate pieces of material and connected together using suitable connecting members to form the open block structure shown in FIGS. 2–8. For example, suitable connecting members include threaded nuts and bolts and/or connecting plates. The members of the ladder-like frames 2–5, 7–8 and the corner modular unit 6 may also be connected together by welding when these are formed of a metal.

Furthermore, although each of the ladder-like frames 2–5 and 7–8 is shown in the drawings with a specific number of reinforcing members, it is understood that the number of reinforcing members may vary depending on the length of the ladder-like frame selected (e.g., the distance between the upper and lower members 2B of the first ladder-like frame 2). For example, the ladder-like frame 2 may have two reinforcing members 2C, as shown in FIG. 1, or five reinforcing members 2C, as shown in FIG. 2.

Figure 9:
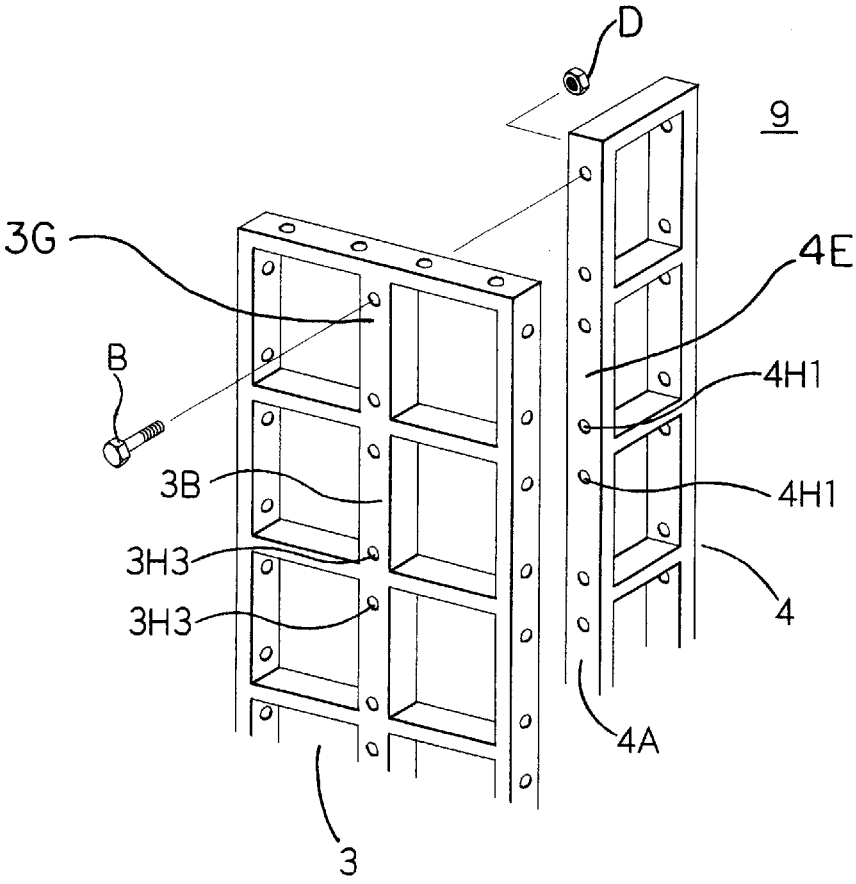
FIG. 9 is an exploded perspective view of a T-type frame utilized in a modular structure according to the present invention.
Figure 10:
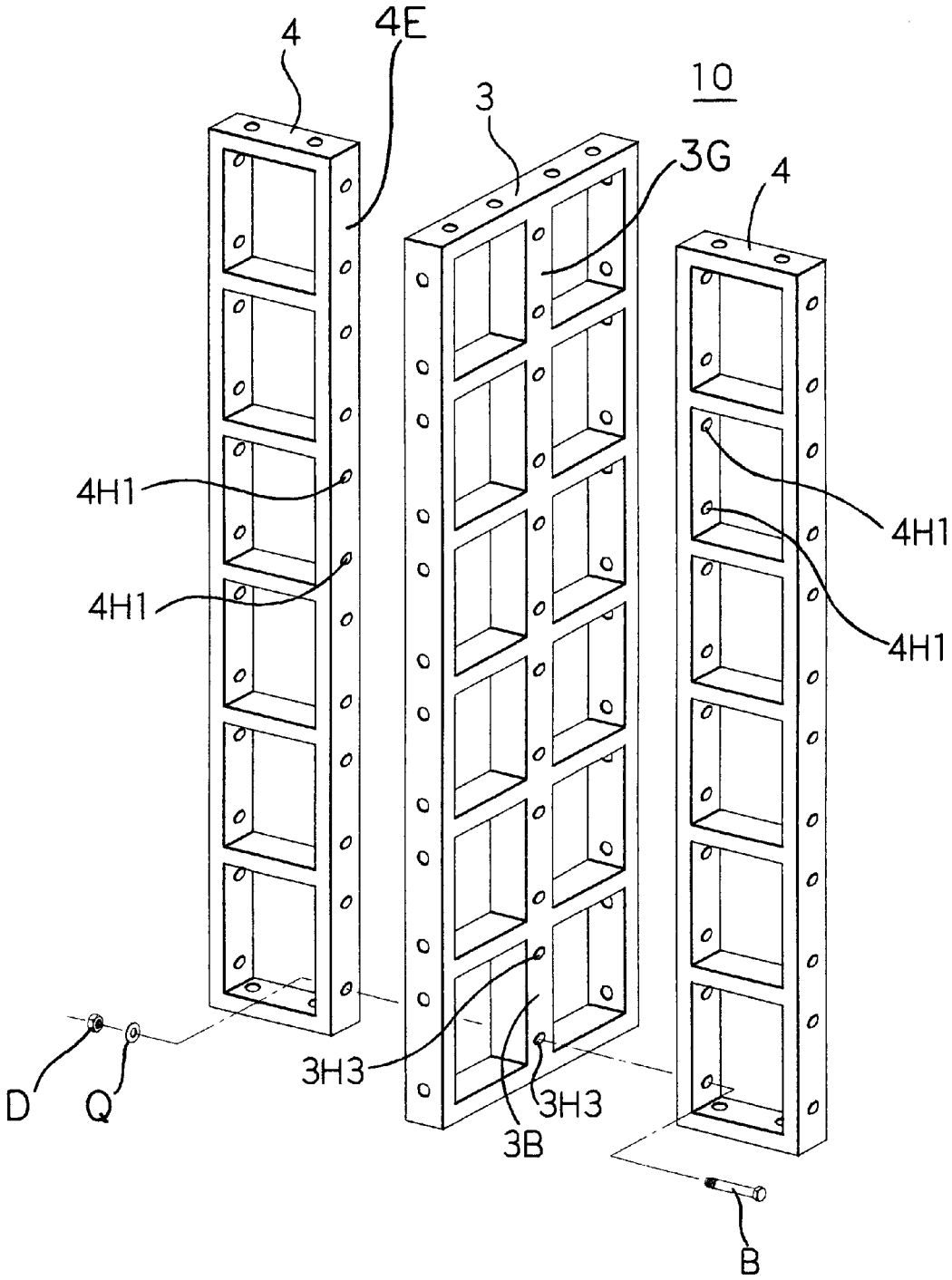
FIG. 10 is an exploded perspective view of a +(plus)-type frame utilized in a modular structure according to the present invention.
Figure 14:
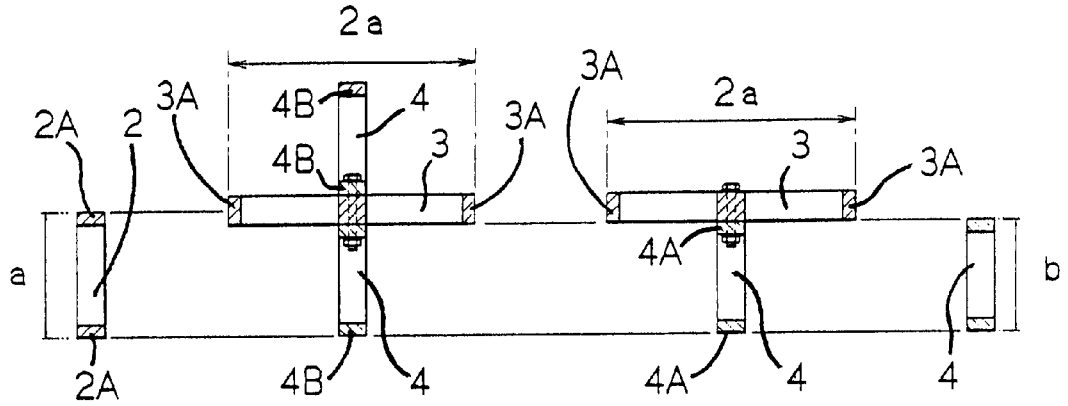
FIG. 14 is a schematic plane view illustrating the dimensions of the first, second and third ladder-like frames according to the present invention.
Figure 15:
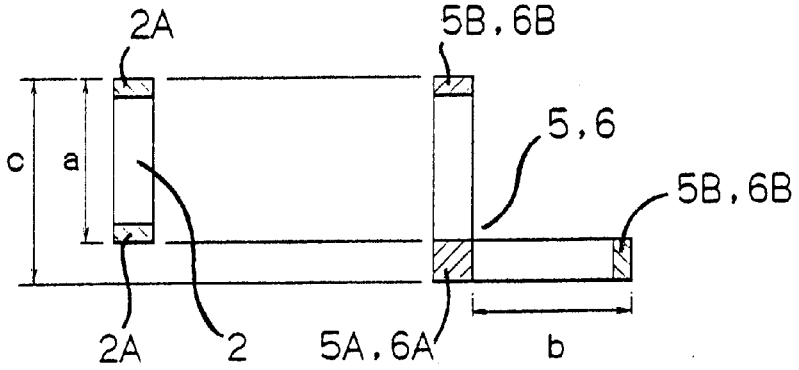
FIG. 15 is a schematic plane view illustrating the dimensions of the first ladder-like frame, the fourth ladder-like frame, and the L-shaped modular unit according to the present invention.

FIGS. 14 and 15 show the dimensional relation between the ladder-like frames 2–5, 7–8 and the corner modular unit 6. The size of the first ladder-like frame 2 is denoted by a (hereinafter referred to as "the standard size a") and corresponds to the distance between the connecting surfaces 2E of the left and right members 2A. The size of the second ladder-like frame 3 is selected to be 2*a* (i.e., two-times the standard size a) and corresponds to the distance between the connecting surfaces 3F of the left and right members 3A. The size of the third ladder-like frame 4 (i.e., the distance between connecting surfaces 4E of the left and right members 4A) is denoted by b and is selected to be less than the standard size a (i.e., a>b). With reference to FIG. 2, the dimension b is obtained by adding the length l of any one of the reinforcing members 2C of the first ladder-like frame 2 to the thickness t of one of the left and right members 2A (i.e., b=l+t). By the foregoing relation between the dimensions a and b, the third ladder-like frame 4 can be used to construct T-type frames 9 and +-type frames 10 as shown in FIGS. 9 and 10.

Referring to FIG. 15, the size of the fourth ladder-like frame 5 is denoted by c and is selected to be greater than the standard size a (i.e., c>a). With reference to FIG. 5, the dimension c corresponds to the distance between a surface 5A1 of the pillar-like member 5A and the connecting surface 5F of the left vertical member 5B, or to the distance between a surface 5A2 of the pillar-like member 5A and the connecting surface 5F of the right vertical member 5B. Thus, the dimension c of the fourth ladder-like frame 5 is obtained by adding the standard size a to a width h of any one of the surfaces 5A1 and 5A2 of the pillar-like member 5A (i.e., c=a+h).

The size of the corner modular unit 6 is selected to be c as set forth above for the fourth ladder-like frame 5. More specifically, with reference to FIG. 6, the dimension c corresponds to the distance between a surface 6A1 of the pillar-like member 6A and the connecting surface 6E of the left vertical member 6B, or to the distance between a surface 6A2 of the pillar-like member 6A and the connecting surface 6E of the right vertical member 6B. Thus, the dimension c of the modular unit 6 is obtained by adding the standard size a to a width k of any one of the surfaces 6A1 and 6A2 of the pillar-like member 6A (i.e., c=a+k).

Although not shown in FIGS. 14 and 15, the dimensions of the fifth ladder-like frame 7 and the sixth ladder-like frame 8 are selected to be equal to the standard size a. For the fifth ladder-like frame 7, the standard size a corresponds to the distance between the connecting surfaces 7E of the upper and lower members 2A. For the sixth ladder-like frame 8, the standard size a corresponds to the distance between the connecting surfaces 8D of the front and rear members 8A.

According to the present invention, the connecting through-holes of the ladder-like frames 2–5, 7–8 and the corner modular unit 6 are formed at predetermined positions on the connecting surfaces such that when the respective connecting surfaces are superimposed for connection thereof, the connecting through-holes formed on the respective connecting surfaces are automatically aligned to allow passage therethrough of connecting elements for connecting one or more of the ladder-like frames 2–5, 7–8 and the corner modular unit 6 to one another to construct a modular structure according to the present invention.

Figure 17:
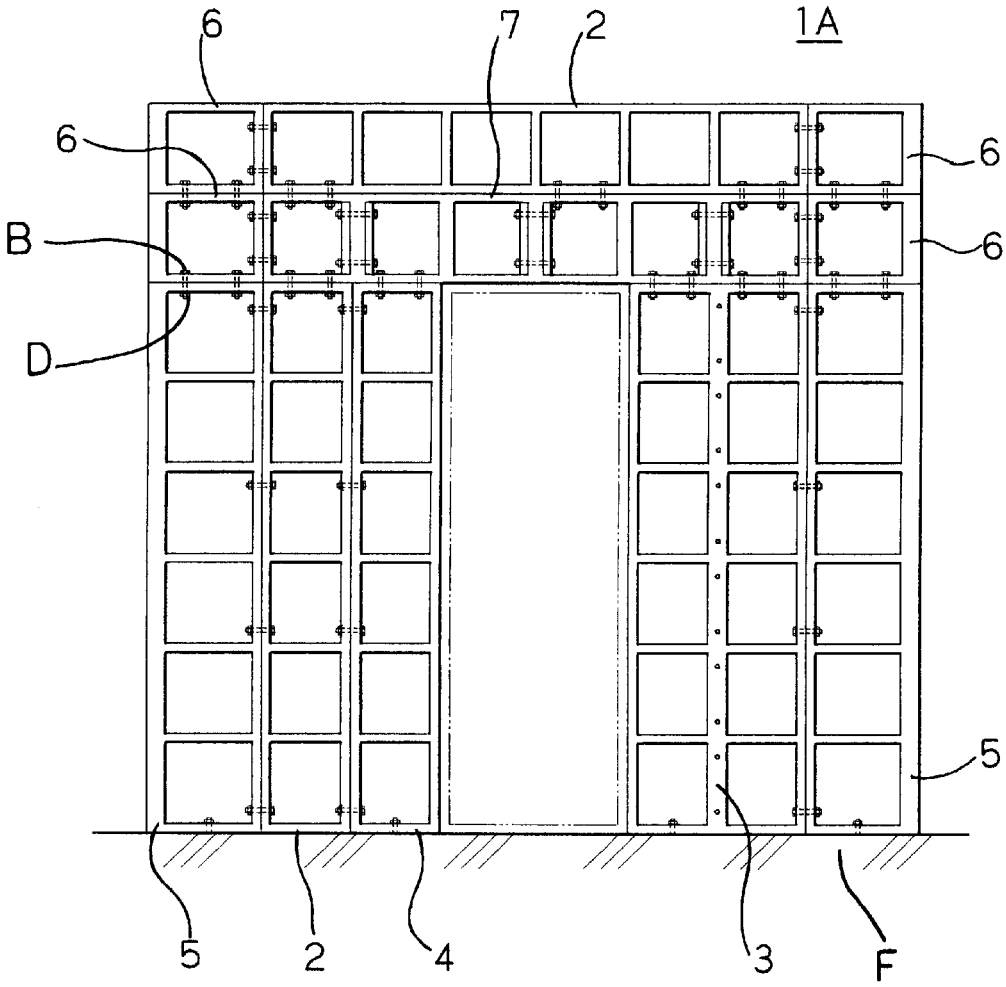
FIG. 17 is a rear view of the one-story building shown in FIG. 16.
Figure 18:
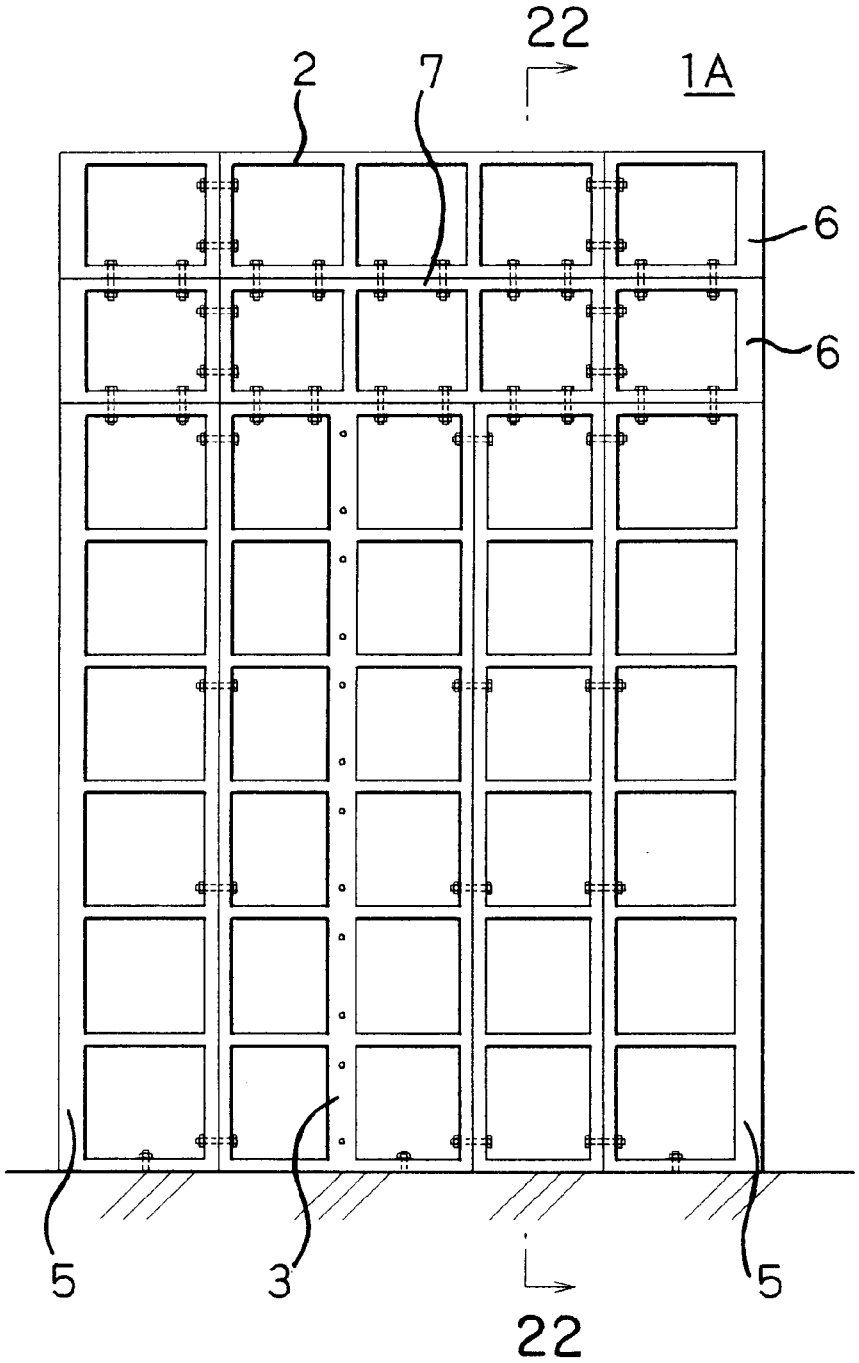
FIG. 18 is a left-side view of the one-story building shown in FIG. 16.
Figure 19:
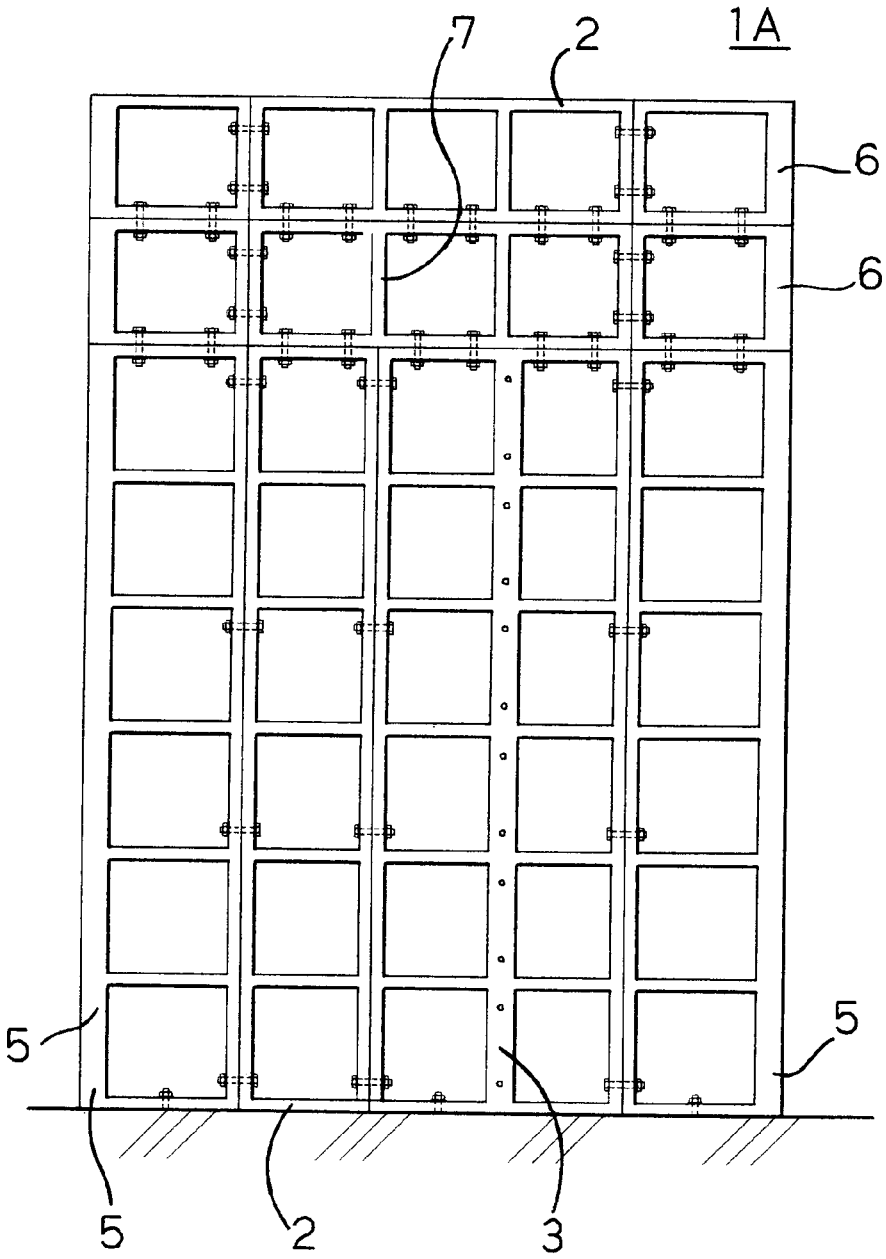
FIG. 19 is a right-side view of the one-story building shown in FIG. 16.
Figure 20:
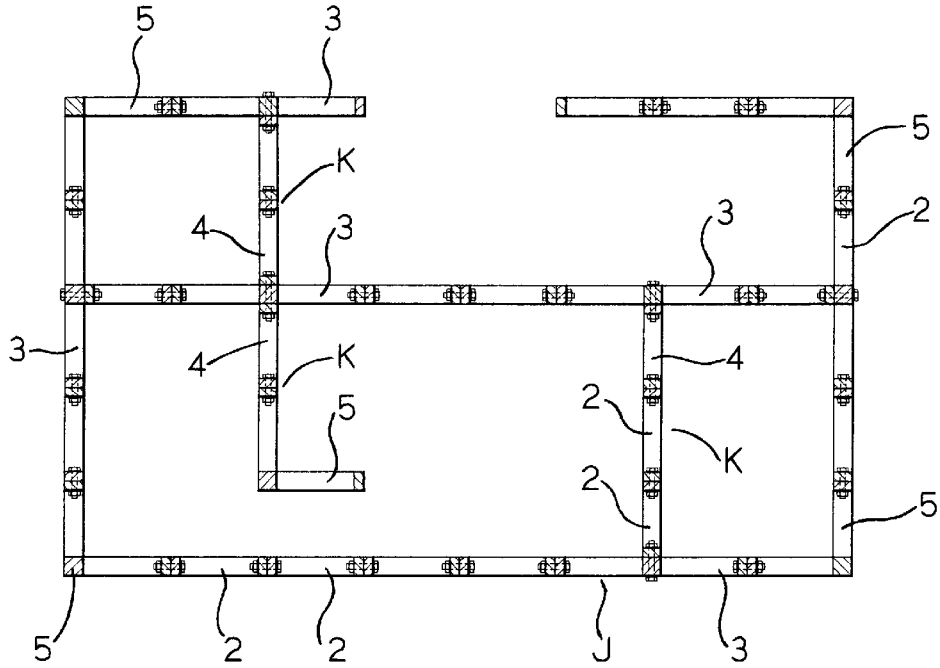
FIG. 20 is a cross-sectional view taken along lines 20—20 of FIG. 16.

For example, as shown in FIG. 17, when the first ladder-like frame 2, the second ladder-like frame 3, the third ladder-like frame 4, the fourth ladder-like frame 5 and the corner modular unit 6 are assembled in parallel relation, the horizontal connecting through-holes formed on the respective connecting surfaces of these frames and corner modular unit are automatically aligned to allow passage therethrough of connecting elements, such as threaded bolts B which are then secured with threaded nuts D, for connecting the frames and the corner modular units to one another. Likewise, as shown in FIG. 1, when the first ladder-like frame 2, the second ladder-like frame 3, the fourth ladder-like frame 5 and the corner modular unit 6 are assembled in parallel relation and then the fifth ladder-like frame 7 is assembled as a crossbeam relative to the ladder-like frames 2, 3 and 5 and the corner modular unit 6, the vertical connecting through-holes formed in the connecting surfaces of the ladder-like frames 2, 3 and 5 and the corner modular unit 6 are automatically aligned with respective ones of the vertical connecting through-holes 7H1 formed in connecting surfaces 7E of the lower members 7A for receiving therethrough threaded bolts B which are then secured with threaded nuts D.

Furthermore, when any one of the first ladder-like frame 2, the third ladder-like frame 4, the fourth ladder-like frame 5 and the corner modular unit 6 is connected to the pillar-like member 3B of the second ladder-like frame 3, the horizontal connecting through-holes 3H3 formed in the connecting surface 3G of the pillar-like member 3B of the second ladder-like frame 3 are automatically aligned with respective ones of the horizontal connecting through-holes of the corresponding ladder-like frame or corner modular unit. For example, FIG. 9 shows a structural assembly according to the present invention constructed by connecting one of the third ladder-like frames 4 to one of the second ladder-like frames 3. The frames are assembled by aligning horizontal connecting through-holes 4H1 of the third ladder-like frame 4 with respective ones of the horizontal connecting through-holes 3H3 formed in the connecting surface 3G of the pillar-like member 3B of the second ladder-like frame 3 and passing threaded bolts B therethrough which are then secured with threaded nuts D to connect the frames to one another. When the second and third ladder-like frames 3, 4 are connected together as described above, a structural assembly 9 is constructed having a generally T-shaped outline when viewed from above in FIG. 9 (hereinafter referred to as a "T-type frame"). Alternatively, one of the first ladder-like frames 2 may be used instead of the third ladder-like frame 4 to construct the T-type frame with the second ladder-like frame 3.

FIG. 10 shows a structural assembly according to the present invention constructed by connecting two of the third ladder-like frames 4 to one of the second ladder-like frames 3. The frames are assembled by aligning horizontal connecting through-holes 4H1 of each of the third ladder-like frames 4 with respective ones of the horizontal connecting through-holes 3H3 formed in the connecting surface 3G of the pillar-like member 3B of the second ladder-like frame 3 and passing threaded bolts B therethrough which are then secured with threaded nuts D and washers O to connect the frames to one another. When the second and third ladder-like frames 3, 4 are connected together as described above, a structural assembly 10 is constructed having a generally +-shaped outline when viewed from above in FIG. 10 (hereinafter referred to as a "+-type frame"). Alternatively, two of the first ladder-like frames 2 may be used instead of the third ladder-like frames 4 to construct the +-type frame with the second ladder-like frame 3.

Figure 30:
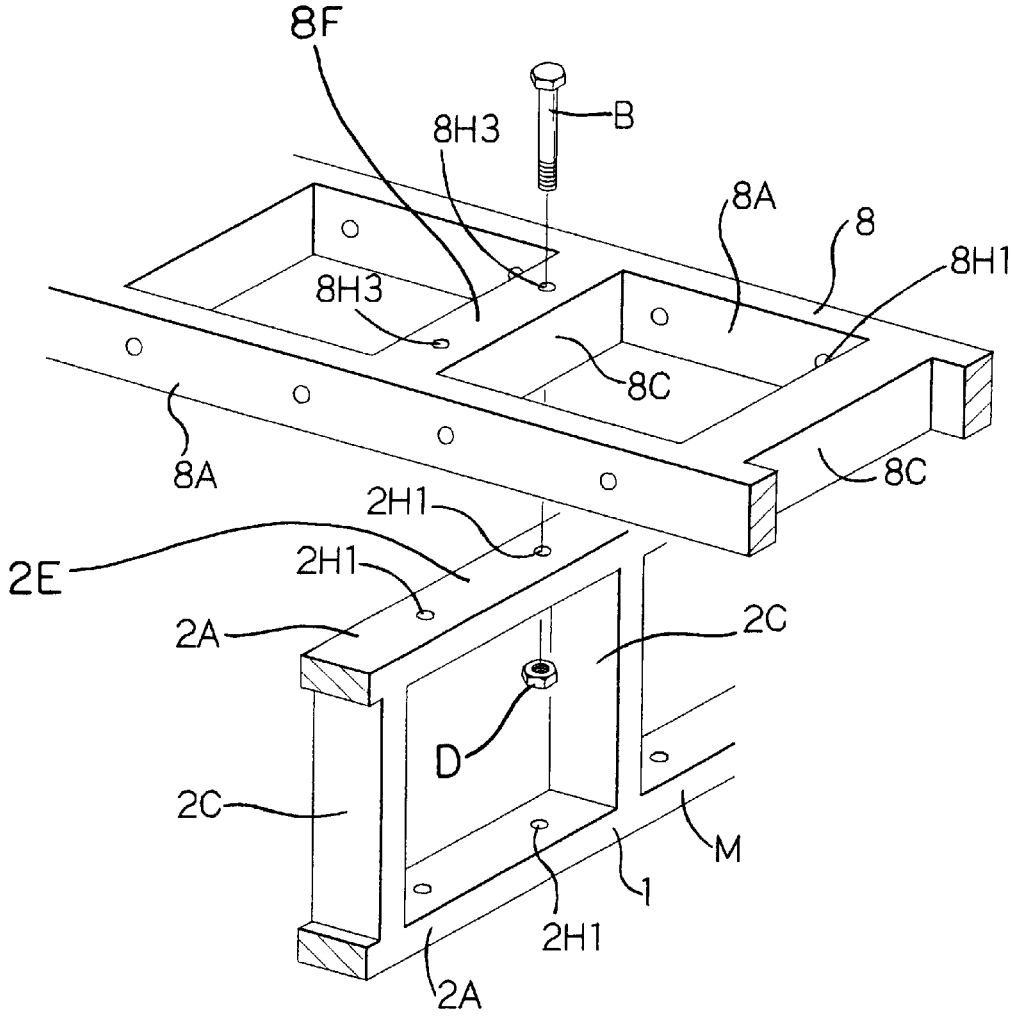
FIG. 30 is an exploded perspective view showing a method of connecting the first ladder-like frame to the sixth ladder-like frame according to the present invention.

Another structural assembly shown in FIG. 30 shows the connection between the sixth ladder-like frame 8 to the first ladder-like frame 2. The vertical connecting through-holes 8H3 are formed in connecting surfaces 8F of the reinforcing members 8C so that when connecting surfaces of the sixth ladder-like frame 8 are brought into abutment with connecting surfaces of the first ladder-like frame 2, the vertical connecting through-holes 8H3 become automatically aligned with respective ones of the horizontal connecting through-holes 2H1 formed in connecting surfaces 2E of the left and right members 2A of the first ladder-like frame 2 for receiving therethrough threaded bolts B which are then secured with threaded nuts D to connect the first and sixth ladder-like frames to one another.

Thus, as described above, connection of the ladder-like frames and the corner modular units to one another is accomplished by first bringing the respective connecting surface of each ladder-like frame or corner modular unit into abutment to form a connecting junction so that respective connecting through-holes formed on the connecting surfaces are aligned with one another. The ladder-like frames and the corner modular units are then connected by inserting a threaded bolt B through each through hole and securing the threaded bolt with a threaded nut D.

Methods for constructing modular structures employing the modular units of the present invention will now be described with a particular application to modular building structures.

FIGS. 9–11, 13, 16–23 and 28 illustrate a method for constructing a modular building structure in the form of a one-story building 1A. A foundation F preferably comprised of a suitable concrete material is prepared using conventional methods. A wall face J of a first floor is then constructed by first assembling an appropriate number of first ladder-like frames 2, second ladder-like frames 3, third ladder-like frames 4 and fourth ladder-like frames 5 assembled in vertical parallel relation on the foundation F and then successively connecting these frames to each other as described above by means of connecting elements, such as threaded bolts B and threaded nuts D. The respective ladder-like frames may be connected to the foundation by means of conventional anchor bolts (not shown) utilizing the vertical connecting through-holes of the ladder-like frames.

When it is desired to form partitions K within the wall face J of the first floor (see FIGS. 20–21), the T-type frames 9 shown in FIG. 9 or the +-type frames 10 shown in FIG. 10 are used. A corresponding number of ladder-like frames according to the present invention are then connected to the T-type frames 9 or +-type frames 10 by means of connecting elements, such as threaded bolts B and threaded nuts D, to form the partitions K.

Figure 13:
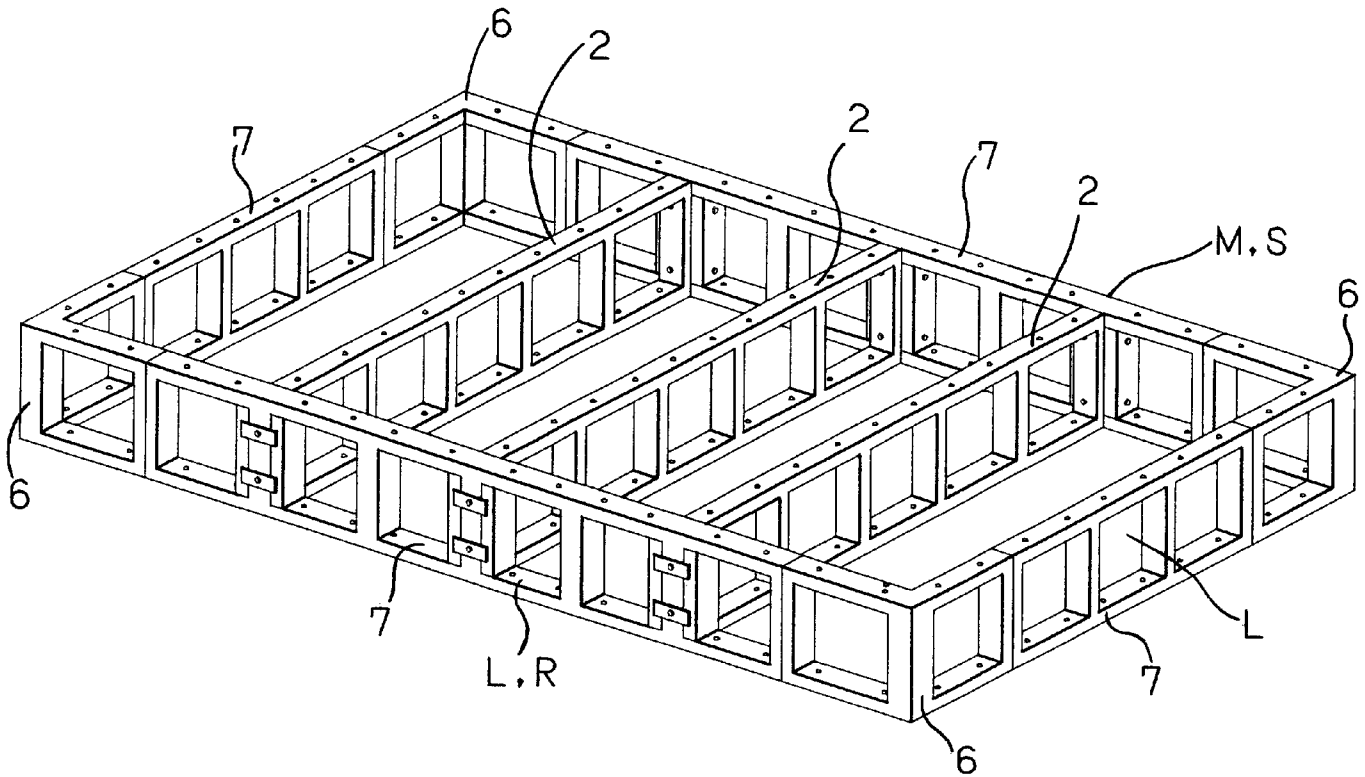
FIG. 13 is a perspective view showing a modular structure constructed using first ladder-like frames, fifth ladder-like frames, and L-shaped modular units according to the present invention.
Figure 21:
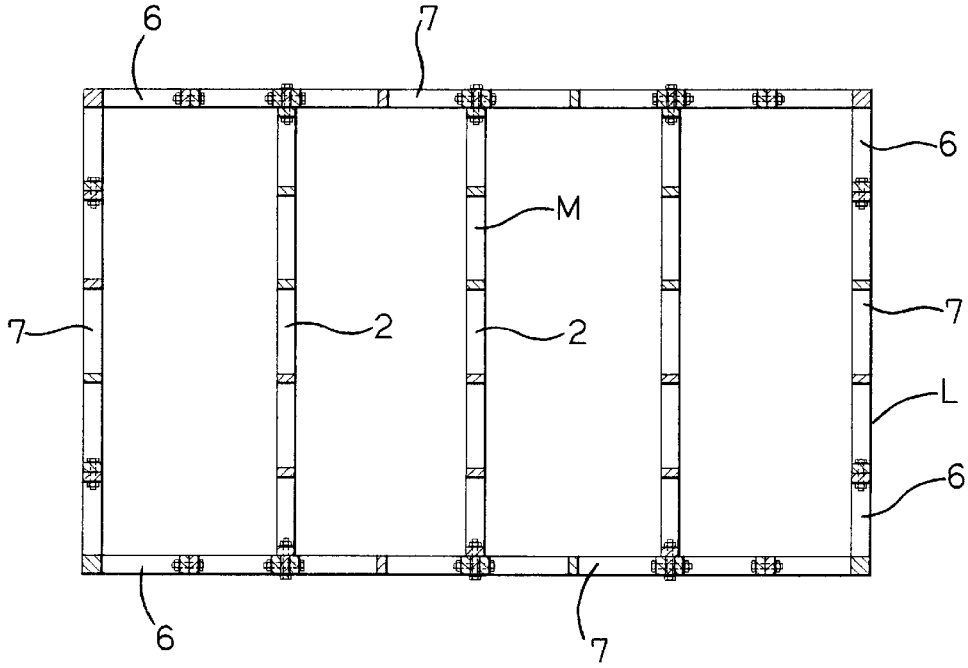
FIG. 21 is a cross-sectional view taken along lines 21—21 of FIG. 16.

As shown in FIGS. 13 and 21, a crossbeam L of the first floor is constructed by assembling a corresponding number of fifth ladder-like frames 7 and corner modular units 6 on an upper surface of the wall face J of the first floor and then connecting these together as described above. For example, vertical connecting through-holes on the surface of the wall face J of the first floor and the vertical connecting through-holes 7H1 of the fifth ladder-like frames 7 are respectively aligned and connection is made using threaded bolts B and nuts D as described above. Similarly, the vertical connecting through-holes on the surface of the wall face J of the first floor and the vertical connecting through-holes 6H2 of the corner modular units 6 are respectively aligned and connection is made using threaded bolts B and nuts D as described above. The corresponding connecting through-holes of the fifth ladder-like frames 7 and the corner modular units 6 are also aligned and similar types of connections are made to connect the frames and corner modular units together to obtain the crossbeam L of the first floor.

As shown in FIGS. 13 and 21, a crossbeam M of the first floor is then constructed using an appropriate number of first ladder-like frames 2. The first ladder-like frames 2 are positioned horizontally in spaced apart relation inside of the crossbeam L of the first floor. The vertical connecting through-holes 2H2 of the first ladder-like frames 2 and the horizontal connecting through-holes 7H4 of the fifth ladder-like frames 7 are aligned and the frames are connected together by means of connecting elements as described above.

Figure 11:
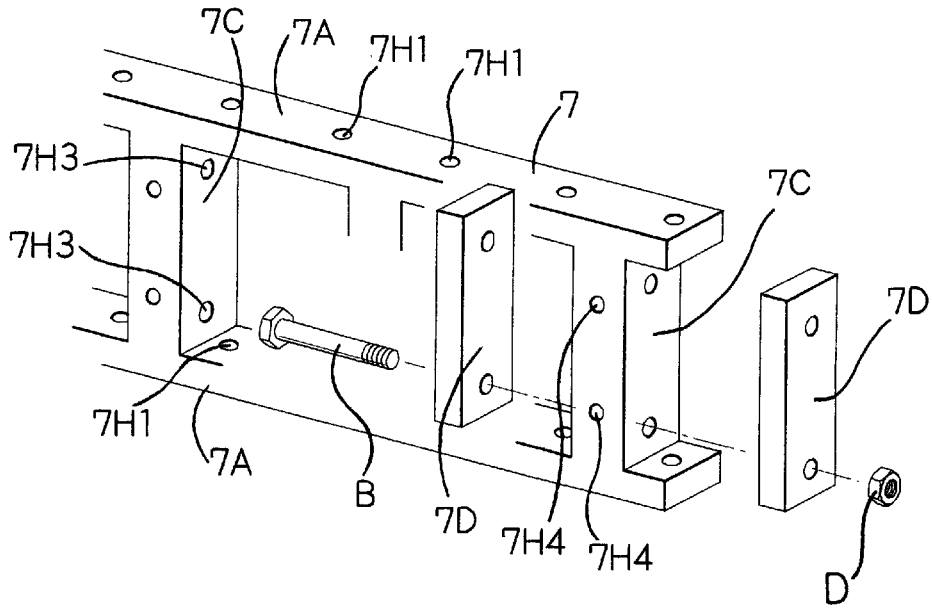
FIG. 11 is an enlarged and exploded perspective view showing the manner of connecting a backplate to the fifth ladder-like frame according to the present invention.
Figure 12:
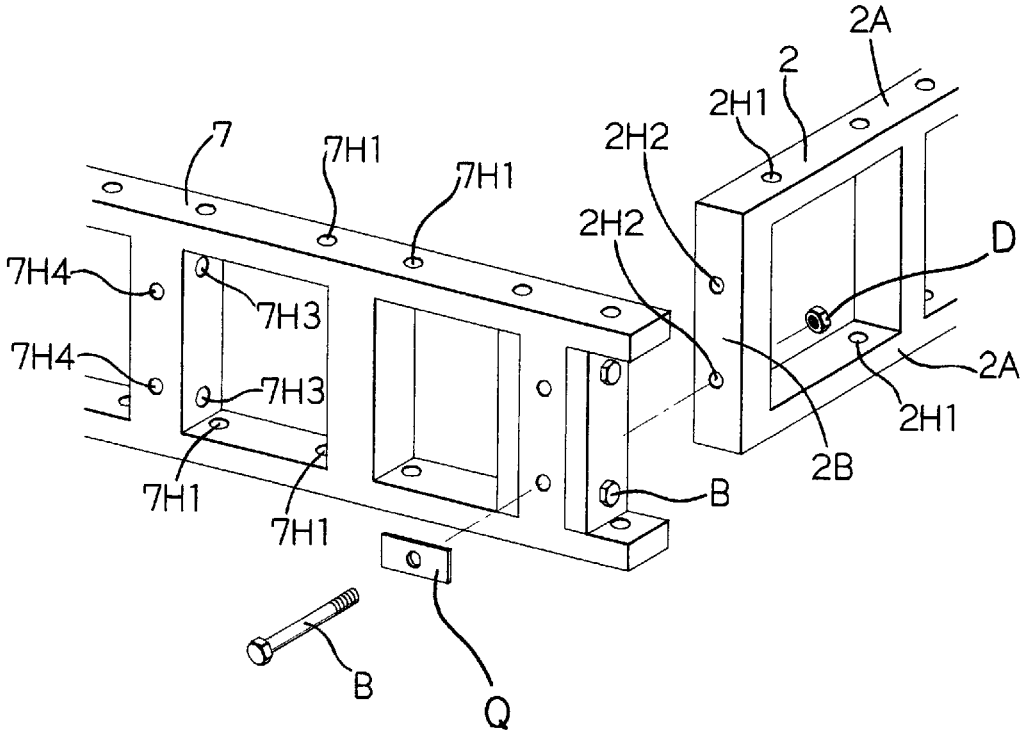
FIG. 12 is a fragmentary enlarged and exploded perspective view showing the manner of connecting the first ladder-like frames to the fifth ladder-like frames according to the present invention.

In the crossbeam M shown in FIGS. 13 and 21, the first ladder-like frames 2 are connected to reinforcing members 7C of the fifth ladder-like frames 7. Preferably, as shown in FIG. 11, the structure of the crossbeam M is reinforced by connecting backplates 7D to opposite side surfaces of the reinforcing members 7C of the fifth ladder-like frames 7 to which the first ladder-like frames 2 are connected. For this purpose, horizontal connecting through-holes 7H3 of the fifth ladder-like frames 7 are utilized and the backplates 7D are connected to the reinforcing members 7C using threaded bolts B and nuts D. The first ladder-like frames 2 are then connected to the fifth ladder-like frames 7 as shown in FIG. 12. Additionally, reinforcing plates 7E are preferably connected to left and right surfaces of the first ladder-like frames 2 using suitable connectors to further reinforce the crossbeam M (see FIG. 28).

Figure 16:
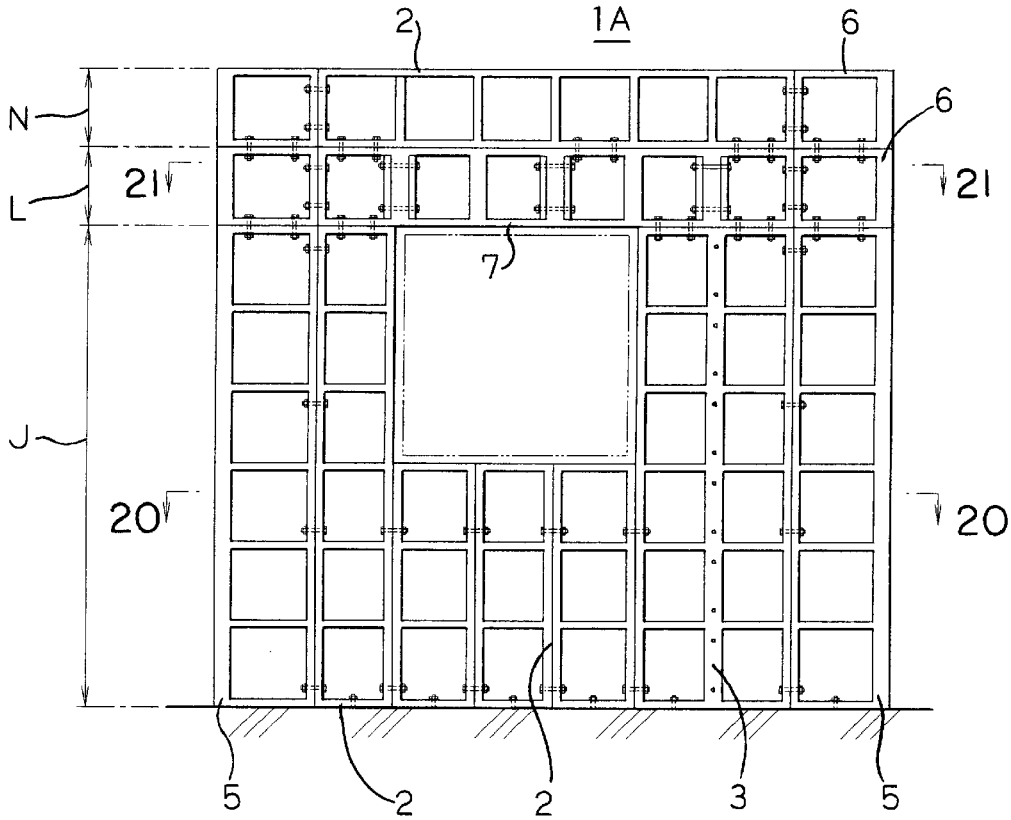
FIG. 16 is a front view of a one-story building according to the present invention.
Figure 22:
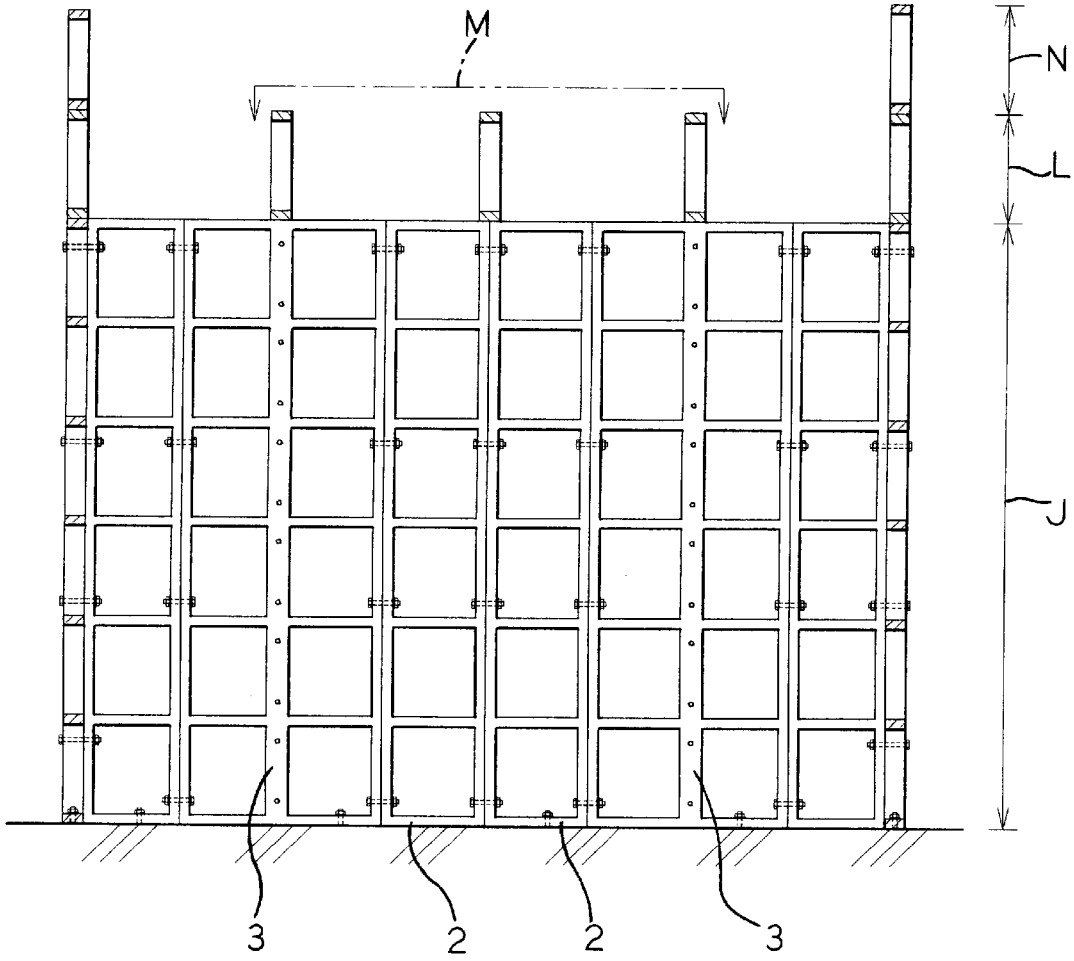
FIG. 22 is a cross-sectional view taken along lines 22—22 of FIG. 18.

As shown in FIGS. 16 and 22, a parapet N is then constructed using an appropriate number of corner modular units 6 and first ladder-like frames 2. The corner modular units 6 are positioned at corner positions on an upper surface of the crossbeam L of the first floor and the first ladder-like frames 2 are positioned horizontally on the upper surface of the crossbeam L. The corner modular units 6 and the first ladder-like frames 2 are then connected by means of connecting elements as described above to form the parapet N.

Figure 23:
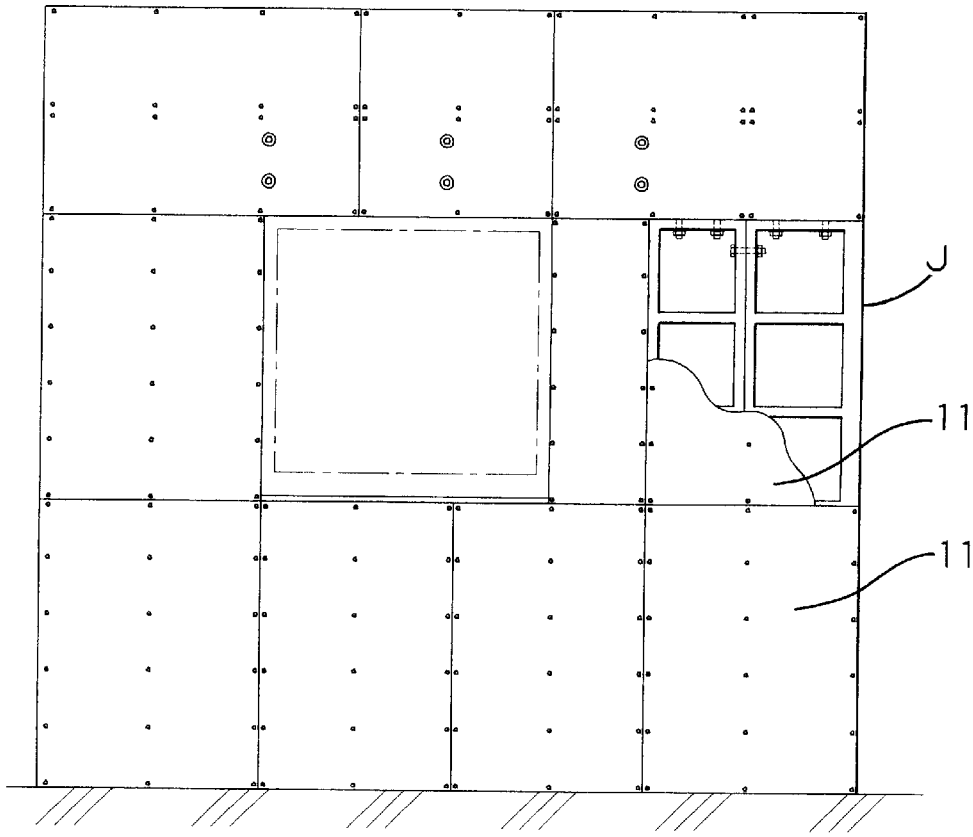
FIG. 23 is a partially cutaway view showing a method of assembling a floor structure of a first floor for a modular structure according to the present invention.

After completion of the wall face J, the crossbeams L, M and the parapet N, the respective structural components of the ladder-like frames and corner modular units form a crosspiece structure of the one-story building 1A. As shown in FIG. 23, panel assemblies 11 are then connected to the crosspiece structure using conventional connecting means, such as screws, bolts, or nails.

Figure 24:
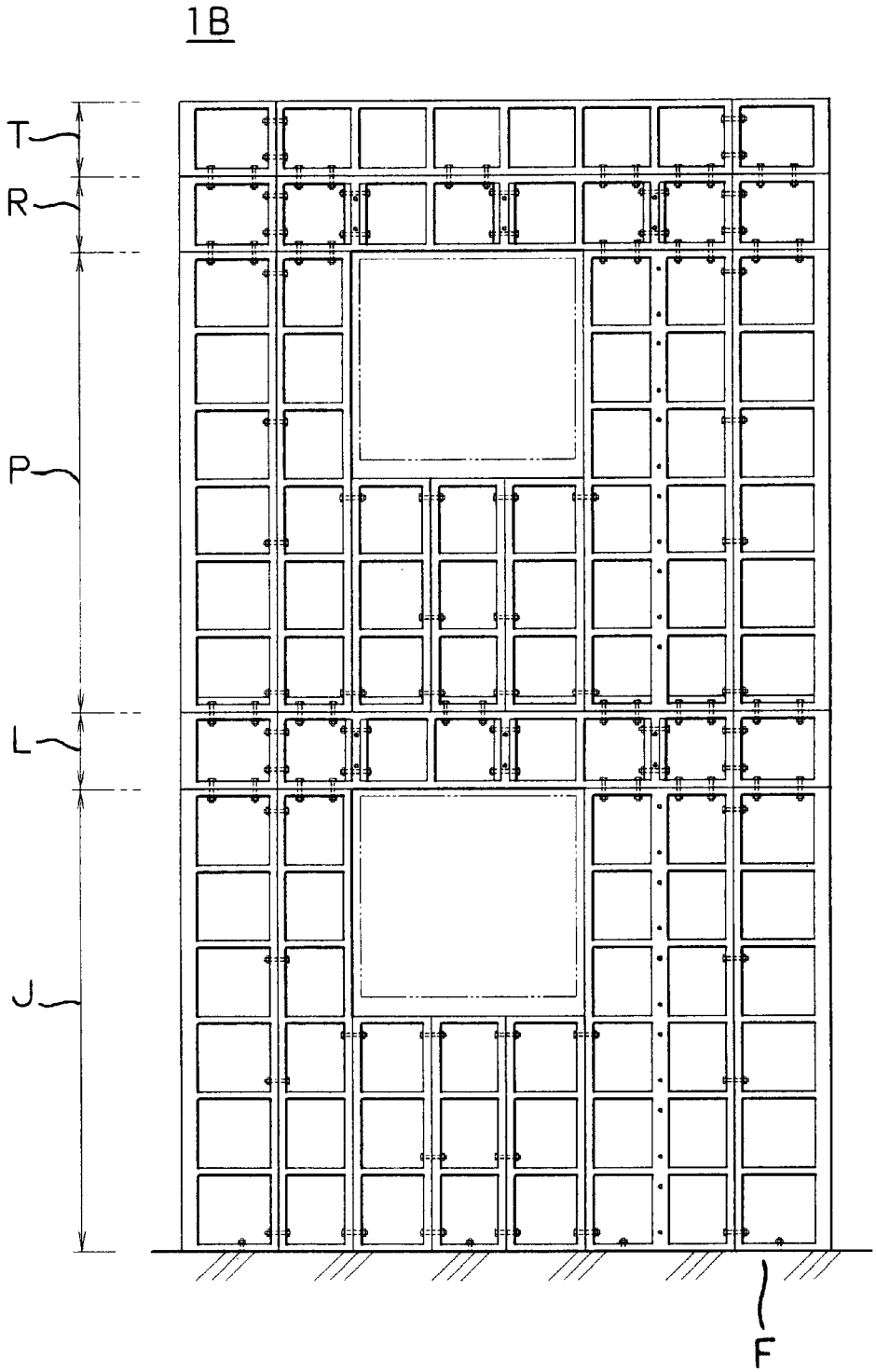
FIG. 24 is a side view showing a two-story building according to the present invention.

FIGS. 9, 10, 24–27 and 29 illustrate a method for constructing a modular building structure in the form of a two-story building 2A. A foundation F preferably comprised of a suitable concrete material is prepared using conventional methods. As shown in FIG. 24, a wall face J of a first floor is constructed by first assembling first ladder-like frames 2, second ladder-like frames 3, third ladder-like frames 4 and fourth ladder-like frames 5 in vertical parallel relation on the foundation F and then successively connecting these frames to each other by means of connecting elements as described above. The respective ladder-like frames may be connected to the foundation by means of conventional anchor bolts (not shown) utilizing the vertical connecting through-holes of the ladder-like frames. The partitions K within the wall face J of the first floor (FIGS. 20–21) and the crossbeams L and M of the first floor (FIGS. 13, 21) are then constructed as described above for the method of constructing the one-story building 1*a*.

Figure 27:
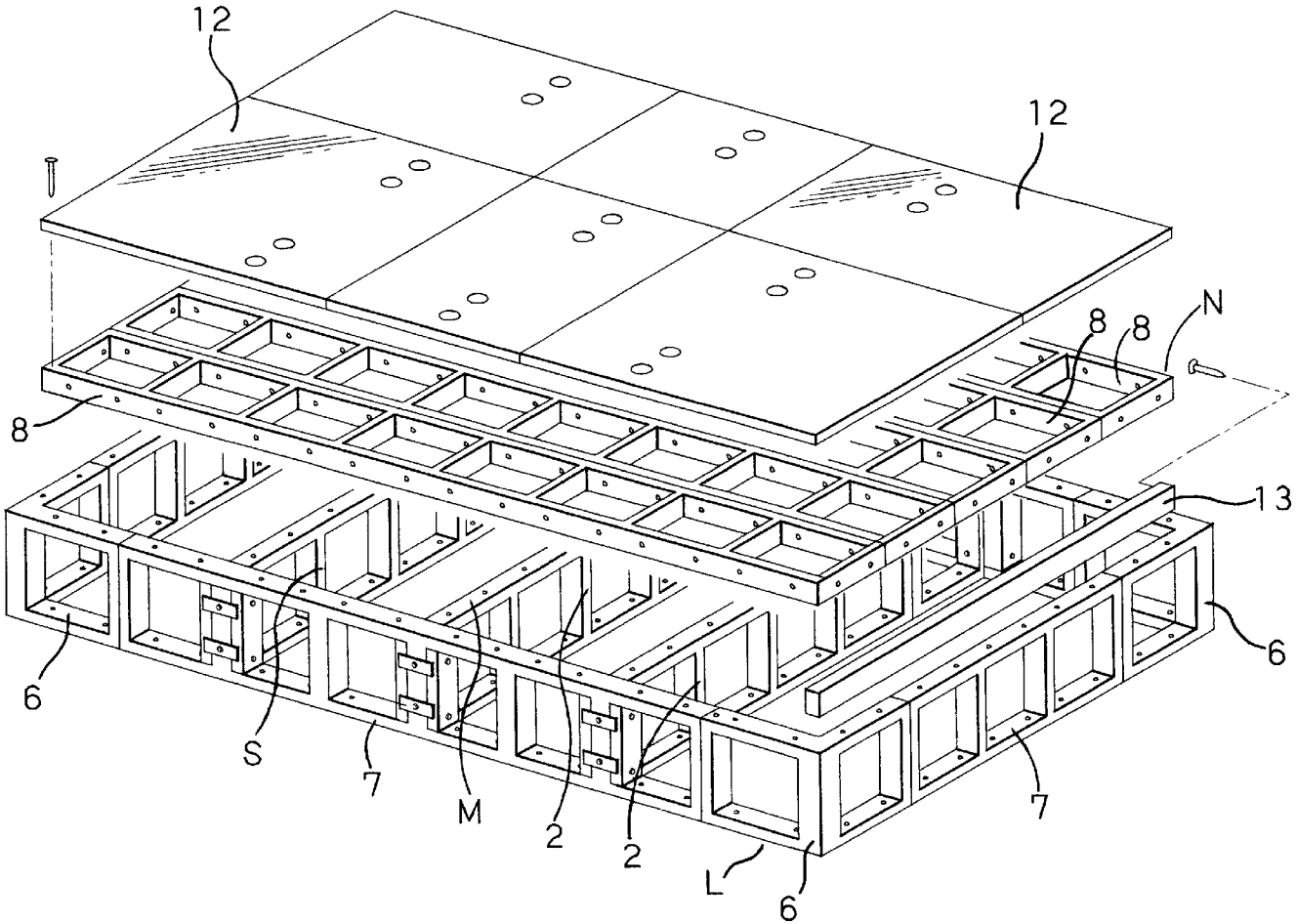
FIG. 27 is an exploded perspective view showing a method of assembling a floor structure using ladder-like frames and L-shaped frames according to the present invention.
Figure 28:
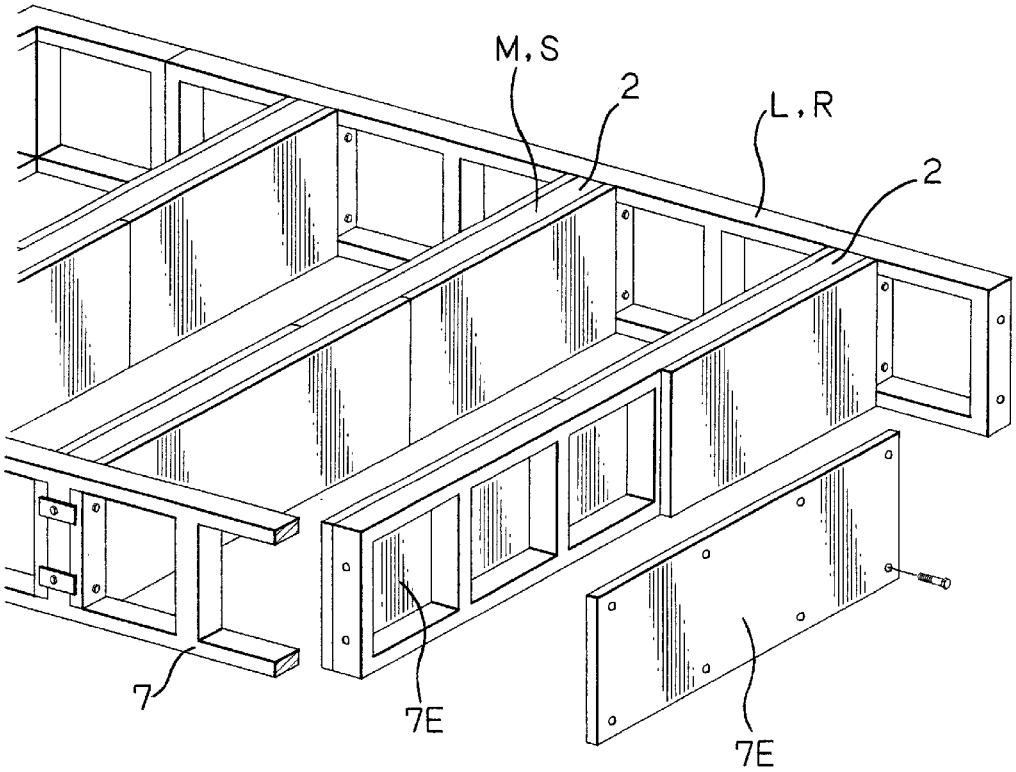
FIG. 28 is an exploded perspective view showing a method of assembling a beam portion utilizing ladder-like frames and L-shaped frames according to the present invention.
Figure 29:
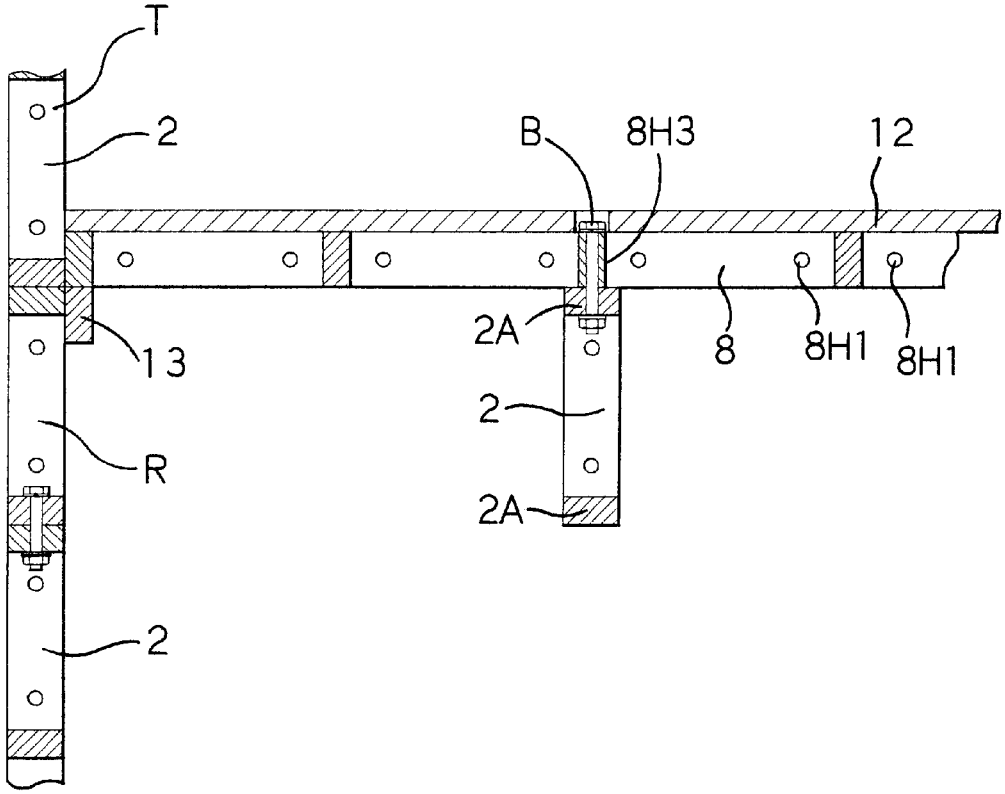
FIG. 29 is a vertical sectional view showing a method of assembling floor, beam and crossbeam portions for a modular structure according to the present invention.

Referring now to FIGS. 27 and 29, an appropriate number of the sixth ladder-like frames 8 are disposed horizontally on the upper surface of the crossbeam M of the first floor. The sixth ladder-like frames 8 are then connected to the first ladder-like frames 2 via vertical connecting through-holes 8H3 and horizontal connecting through-holes 2H1 by means of connecting elements, such as threaded bolts B and threaded nuts D. Thereafter, the sixth ladder-like frames 8 are connected to one another via horizontal connecting through-holes 8H1 and a floor plate 12 is connected to upper surfaces of the sixth ladder-like frames 8 to form a floor structure. For this purpose, a backplate 13 is connected to an inner side of the crossbeam M using suitable connectors (e.g., nails, screws), and an end portion of the floor structure is supported on the backplate 13 as shown in FIG. 29.

Referring to FIG. 24, a wall face P of the second floor is constructed by first assembling first ladder-like frames 2, second ladder-like frames 3, third ladder-like frames 4 and fourth ladder-like frames 5 in vertical parallel relation on the upper surface of the crossbeam L of the first floor. The ladder-like frames 2–5 are then successively connected to one another via corresponding horizontal connecting through-holes by means of connectors as described above to form the wall face P of the second floor.

When it is desired to form partitions K within the wall face P of the second floor, the T-type frames 9 shown in FIG. 9 or the +-type frames 10 shown in FIG. 10 are used. A corresponding number of ladder-like frames according to the present invention are then connected to the T-type frames 9 or +-type frames 10 by means of connecting elements, such as threaded bolts B and threaded nuts D, to form the partitions K.

Figure 26:
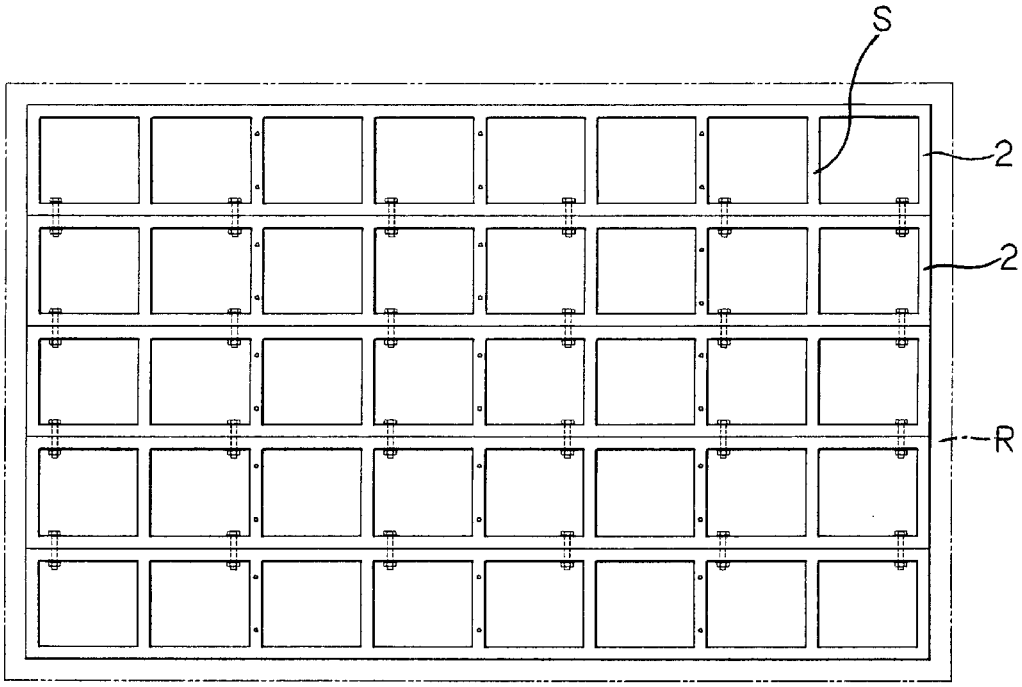
FIG. 26 is a schematic view of a floor structure of a second floor for a modular structure according to the present invention.

As shown in FIGS. 24 and 26, a crossbeam R of the second floor is then constructed using an appropriate number of fifth ladder-like frames 7 and corner modular units 6. The fifth ladder-like frames 7 and the corner modular units 6 are mounted on an upper surface of the wall face P of the second floor and are connected to the first ladder-like frames 2 and the corner modular units 6 forming the wall face J of the first floor via corresponding connecting through-holes by means of connecting elements, such as threaded bolts B and threaded nuts D, to form the crossbeam R.

Referring now to FIG. 26, a crossbeam S of the second floor is then constructed using an appropriate number of first ladder-like frames 2. The first ladder-like frames 2 are positioned horizontally in spaced apart relation inside of the crossbeam R of the second floor. The vertical connecting through-holes 2H2 of the first ladder-like frames 2 and the horizontal connecting through-holes 7H4 of the fifth ladder-like frames 7 are aligned and the frames are connected together by means of connecting elements as described above to form the crossbeam S.

As shown in FIGS. 24 and 29, a parapet T is then constructed using an appropriate number of corner modular units 6 and first ladder-like frames 2. The corner modular units 6 are positioned at corner positions on an upper surface of the crossbeam R of the second floor and the first ladder-like frames 2 are positioned horizontally on the upper surface of the crossbeam R. The corner modular units 6 and the first ladder-like frames 2 are then connected as described above to form the parapet T.

Figure 25:
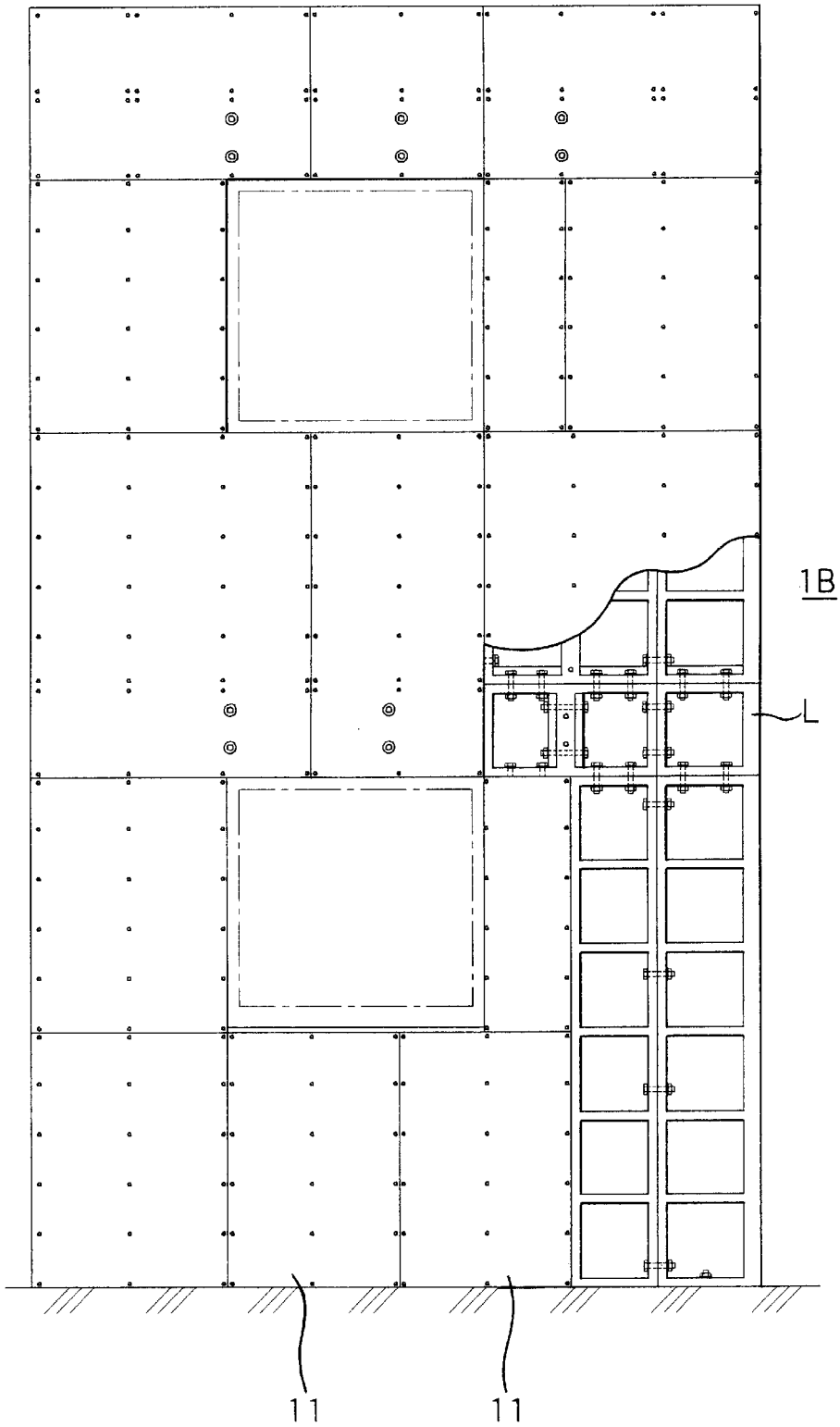
FIG. 25 is a partially cutaway view showing a method of assembling a floor portion of a floor structure for the two-storing building of FIG. 24.

After completion of the wall face J, the partitions K, the crossbeam L, the crossbeam M, the wall face P, the crossbeam R, the crossbeam S and the parapet T, the respective structural components of the ladder-like frames and corner modular units form a crosspiece structure of the two-story building 2A. As shown in FIG. 25, panel assemblies 11 are then connected to the crosspiece structure using conventional connecting means, such as screw, bolts, or nails.

Although the foregoing construction methods according to the present invention have been described with reference to modular building structures, it is understood by those skilled in the art that the particular application to building structures and the configurations thereof shown are for illustrative purposes only and merely represent several of the multitude of different types of modular structures and configurations thereof that can be realized with the modular units of the present invention. Thus the present invention is in no way limited or restricted to the particular modular structures and configurations illustrated in the drawings.

For example, the modular units of the present invention may be secured together to form a suitable enclosure for various types of other uses, such storage facilities. They may be mounted on appropriate foundations of a base, which may for example, be the ground.

Moreover, as described above, each of the modular units is preferably comprised of a block structure (i.e., a structure having components formed of a solid material). Alternatively, the components of each modular unit according to the present invention may be hollow sections (e.g., box-shaped) preferably constructed from a suitable structural material as described above. The hollow sections may be filled, or at least partially filled, with a fairly rigid filler material, such as several known plastics, or the like. In addition, several fairly rigid open-celled materials or foam materials, such as polyurethane, may be introduced into the hollow interior of the components.

The following advantages are achieved by the modular units, modular structures and construction methods of the present invention:

1. The modular units of the present invention can be readily assembled by amateur builders to provide modular structures capable of assuming nearly any shape or size.
2. The number of types of modular units for constructing a modular structure is small, thereby facilitating transportation, loading and unloading operations thereof.

3. The modular units have a configuration (e.g., open structure), size and weight which allows manipulation thereof (e.g., lifting) by one or two persons without requiring the use of any special and/or complex machinery. Furthermore, the modular units may be assembled using a simple scaffold system.
4. The modular units can be connected to one another and to other components of a modular structure by a minimum number of simple connecting elements, such as threaded bolts and threaded nuts, thereby facilitating the construction and strengthening of the modular structures without requiring special skills. Furthermore, only simple tools are required for assembly of the modular units (e.g., for fastening the threaded bolts and threaded nuts).
5. Since the modular units of the present invention are of uniform construction, connection thereof to one another is facilitated and can be accomplished in a relatively short period of time. More specifically, since the modular units are of uniform height, the members of the modular units have a uniform cross-section, and the connecting through-holes are uniformly located in all of the modular units (i.e., formed at the same locations), the connecting through-holes of the modular units can be automatically aligned by simply superimposing the connecting surfaces of the modular units to be connected. Thus the amount of time required to construct a modular structure utilizing the modular units of the present invention is substantially reduced as compared to conventional modular structure construction methods.
6. All of the operations for constructing a modular building structure using the modular units of the present invention, except for the construction of a roof, can be carried out safely from the inside of the building structure as it is being constructed. For example, after the floor of the first floor is laid, the first floor can be used as a scaffold and/or as a support surface for a simple scaffold structure for assembling the walls of the first floor. Similarly, after the floor of the second floor is laid, the second floor can be used as a scaffold and/or as a support surface for a simple scaffold structure for assembling the walls of the second floor and the roof floor.
7. The construction method of the present invention effectively reduces costly amounts of skilled and unskilled labor as well as the amount of construction time.
8. The modular units may be fabricated at a factory, for example, and may be transported for assembly on location by relatively unskilled labor to construct modular structures such as depicted in FIGS. 13 and 16–28.
9. The open structure construction of the modular units of the invention effectively reduces the overall weight of the modular units while providing an overall construction with inherent rigidity. The openings in each of the modular units define open spaces adaptable for receiving, for example, an insulating material during the construction of building structures.
10. The modular units according to the present invention can be assembled to construct modular structures with improved wind load resistance.

From the foregoing description, it can be seen that the present invention comprises an improved modular construction system. It will be appreciated by those skilled the art that obvious changes could be made to the embodiments described in the foregoing description without departing from the broad inventive concept thereof. For example, although the foregoing set of modular units have been described and illustrated with a specific application to modular building structures, it will be appreciated that the foregoing set of modular units are also particularly well adapted for other types of modular structures, such as, for example, container structures and bridge structures. Additionally, the foregoing set of modular units may be assembled to construct modular structures having nearly any shape or size. It is understood, therefore, that this invention is not limited to the particular embodiments disclosed, but is intended to cover all modifications thereof which are within the scope and spirit of the invention as defined by the appended claims.

I claim:

1. A modular unit system for constructing a modular structure, the modular unit system comprising: a plurality of generally different modular unit sets each having a plurality of identical modular units, the modular units of each modular unit set having connecting surfaces each for connection to a corresponding connecting surface of at least one other identical modular unit or to a corresponding connecting surface of one of the modular units of another of the modular unit sets to construct a modular structure having a predetermined configuration, and all of the modular units of each of the modular unit sets having a ladder-like configuration having at least two generally parallel sidepieces connected by at least four crosspieces except for the modular units of one preselected modular unit set; wherein each modular unit of one of the modular unit sets having the ladder-like configuration has a support member disposed between the two generally parallel sidepieces in parallel relation thereto, the support member having at least one connecting surface for connection to a corresponding connecting surface of at least one other identical modular unit or to a corresponding connecting surface of one of the modular units of another of the modular unit sets.

2. A modular unit system according to claim 1; wherein the at least four crosspieces of each of the modular units of a plurality of the modular unit sets having the ladder-like configuration comprise seven crosspieces.

3. A modular unit system according to claim 1; wherein the modular units of the preselected modular unit set have a generally L-shaped outline.

4. A modular unit system according to claim 2; wherein the plurality of generally different modular unit sets comprises at least seven modular unit sets; and wherein the modular units of six of the modular unit sets have the ladder-like configuration and the modular units of the other of the modular unit sets have the generally L-shaped outline.

5. A modular unit system according to claim 1; wherein each modular unit of each modular unit set comprises a single piece of material.

6. A modular unit system according to claim 5; wherein the single piece of material comprises wood.

7. A modular unit system according to claim 1; wherein each modular unit of each modular unit set comprises at least quadrilateral section.

8. A modular unit system according to claim 7; wherein each quadrilateral section comprises a first pair of parallel, spaced-apart members, and a second pair of parallel, spaced-apart members each having an end connected to an end of one of the first pair of members.

9. A modular unit system according to claim 8; wherein the first and second members of each quadrilateral section have the same cross-sectional shape.

10. A modular unit system according to claim 9; wherein the first and second members of each quadrilateral section are generally square-shaped in cross-section.

11. A modular unit system according to claim 8; wherein each of the first and second members has a generally planar surface defining one of the connecting surfaces.

12. A modular unit system according to claim 8; wherein each of the first and second members comprises a solid piece of structural material.

13. A modular unit system according to claim 12; wherein the solid piece of material comprises wood.

14. A modular unit system according to claim 1; wherein each of the modular units of at least one of the modular units sets comprises a plurality of quadrilateral sections connected together in perpendicular relation thereto.

15. A modular unit system according to claim 1; wherein each modular unit of each modular unit set comprises a block.

16. A modular unit system according to claim 15; wherein each block is comprised of a wood material.

17. A modular unit system according to claim 15; wherein each block comprises a single piece of structural material.

18. A modular unit system according to claim 17; wherein the structural material comprises wood.

19. A modular structure construction comprising: a plurality of generally different modular unit sets each having a plurality of identical modular units each having connecting surfaces, all of the modular units of each of the modular unit sets having a ladder-like configuration having at least two generally parallel sidepieces connected by at least four crosspieces except for the modular units of one preselected modular unit set, and each modular unit of one of the modular unit sets having the ladder-like configuration having a support member disposed between the two generally parallel sidepieces in parallel relation thereto, the support member having at least one connecting surface; and means interconnecting the connecting surfaces of each modular unit of each modular unit set to a corresponding connecting surface of at least one other identical modular unit or to a corresponding connecting surface of one of the modular units of another of the modular unit sets to define a modular structure.

20. A modular unit system according to claim 19; wherein the at least four crosspieces of each of the modular units of a plurality of the modular unit sets having the ladder-like configuration comprise seven crosspieces.

21. A modular structure construction according to claim 19; wherein the modular structure comprises a building.

22. A modular structure construction according to claim 19; wherein the modular units of the preselected modular unit set have a generally L-shaped outline.

23. A modular structure construction according to claim 22; wherein each modular unit of each modular unit set comprises a single piece of material.

24. A modular unit system according to claim 23; wherein the single piece of material comprises wood.

25. A building system comprising: a building having a foundation, at least one wall structure, and at least one floor structure for supporting the wall structure on the foundation; wherein the wall structure and the floor structure comprise a plurality of generally different modular unit sets each having a plurality of identical modular units, the modular units of each modular unit set having connecting surfaces connected to a corresponding connecting surface of at least one other identical modular unit or to a corresponding connecting surface of one of the modular units of another of the modular unit sets to define the wall structure and the floor structure, and all of the modular units of each of the modular unit sets having a ladder-like configuration having at least two generally parallel sidepieces connected by at least four crosspieces except for the modular units of one preselected modular unit set; wherein each modular unit of one 3 of the modular unit sets having the ladder-like configuration has a support member disposed between the two generally parallel sidepieces in parallel relation thereto, the support member having at least one connecting surface for connection to a corresponding connecting surface of at least one other identical modular unit or to a corresponding connecting surface of one of the modular units of another of the modular unit sets.

26. A modular unit system according to claim 25; wherein the at least four crosspieces of each of the modular units of a plurality of the modular unit sets having the ladder-like configuration comprise seven crosspieces.

27. A modular structure construction according to claim 25; wherein the modular units of the preselected modular unit set have a generally L-shaped outline.

28. A modular structure construction according to claim 27; wherein each modular unit of each modular unit set comprises a single piece of material.

29. A modular unit system according to claim 28; wherein the single piece of material comprises wood.

30. A method for constructing a building structure, comprising the steps of:

providing a plurality of generally different modular unit sets each having a plurality of identical modular units each having connecting surfaces, all of the modular units of each of the modular unit sets having a ladder-like configuration having at least two generally parallel sidepieces connected by at least four crosspieces except for the modular units of one preselected modular unit set, and each modular unit of one of the modular unit sets having the ladder-like configuration having a support member disposed between the two generally parallel sidepieces in parallel relation thereto, the support member having at least one connecting surface for connection to a corresponding connecting surface of at least one other identical modular unit or to a corresponding connecting surface of one of the modular units of another of the modular unit sets; and connecting the connecting surfaces of each modular unit of each modular unit set to a corresponding connecting surface of at least one other identical modular unit or to a corresponding connecting surface of one of the modular units of another of the modular unit sets to construct the modular building structure.

31. A modular unit system according to claim 30; wherein the at least four crosspieces of each of the modular units of a plurality of the modular unit sets having the ladder-like configuration comprise seven crosspieces.

32. A modular structure construction according to claim 30, wherein the modular units of the preselected modular unit set have a generally L-shaped outline.

33. A modular structure construction according to claim 32; wherein each modular unit of each modular unit set comprises a single piece of material.

34. A modular unit system according to claim 33; wherein the single piece of material comprises wood.

* * * * *